US005960881A

United States Patent [19]

Allamon et al.

[11] Patent Number: 5,960,881

[45] Date of Patent: Oct. 5, 1999

[54] DOWNHOLE SURGE PRESSURE REDUCTION SYSTEM AND METHOD OF USE

[75] Inventors: Jerry P. Allamon; Carroll Kennedy Burgess, Jr.; Jack E. Miller; Kurt D. Vandervort, all of Houston, Tex.

[73] Assignee: Jerry P. Allamon, Montgomery, Tex.

[21] Appl. No.: 08/837,772

[22] Filed: Apr. 22, 1997

[51] Int. Cl.[6] ..... E21B 33/13; E21B 33/00; E21B 23/08

[52] U.S. Cl. ..... 166/291; 166/67; 166/70; 166/95.1; 166/386; 166/285

[58] Field of Search ..... 166/67, 70, 95.1, 166/291, 379, 386, 285; 138/26

[56] References Cited

U.S. PATENT DOCUMENTS

| | | | |
|---|---|---|---|
| 2,737,244 | 3/1956 | Baker et al. | 166/124 |
| 2,947,363 | 8/1960 | Sackett et al. | 166/224 |
| 3,039,531 | 6/1962 | Scott | 166/70 |
| 3,053,322 | 9/1962 | Kline | 166/184 |
| 3,118,502 | 1/1964 | Cochran | 166/129 |
| 3,148,731 | 9/1964 | Holden | 166/184 |
| 3,376,935 | 4/1968 | Baker | 166/224 |
| 3,403,729 | 10/1968 | Hickey | 166/75 |
| 3,730,267 | 5/1973 | Scott | 166/0.5 |
| 3,955,624 | 5/1976 | Fredd et al. | 166/72 |
| 4,033,408 | 7/1977 | Fredd et al. | 166/75 R |
| 4,103,503 | 8/1978 | Smith | 61/97 |
| 4,132,243 | 1/1979 | Kuus | 137/268 |
| 4,252,196 | 2/1981 | Silberman et al. | 166/318 |
| 4,427,065 | 1/1984 | Watson | 166/250 |
| 4,435,872 | 3/1984 | Leikam | 15/104.06 A |
| 4,671,353 | 6/1987 | Daming | 166/70 |
| 4,893,678 | 1/1990 | Stokley et al. | 166/374 |
| 4,916,999 | 4/1990 | Palmer et al. | 89/1.815 |
| 5,181,569 | 1/1993 | McCoy et al. | 166/317 |
| 5,196,652 | 3/1993 | Baker | 166/70 |
| 5,244,044 | 9/1993 | Henderson | 166/332 |
| 5,277,248 | 1/1994 | Breland | 166/70 |
| 5,290,128 | 3/1994 | Yeargain et al. | 405/209 |
| 5,293,933 | 3/1994 | Brisco | 166/70 |

(List continued on next page.)

FOREIGN PATENT DOCUMENTS

| | | | |
|---|---|---|---|
| WO88/01678 | 10/1988 | Netherlands | E21B 33/16 |

OTHER PUBLICATIONS

Brown Oil Tools, Inc. General Catalog, 1962–1963, front cover and p. 887, 2 pages.

Brown Oil Tools, Inc. General Catalog, 1966–1967, front and rear covers and pp. 906–955, in particular, see p. 948 for "Combination Plug Dropping Head and Swivel", "Brown Circulating Valve", "Century Set Shoes Types T, V&K" and "Orifice Float Collar", 52 pages.

Brown Oil Tools, Inc. General Catalog, 1970–1971, front and rear covers and pp. 806–875, in particular, see p. 852 for "Type C–1 "J" Setting Tool", "Type C–1 Setting Tool", "Type CS Setting Tool", "Heavy Duty Dropping Head", and "Combination Plug Dropping Head and Swivel" and p. 854 for "Circulating Valve" and "Cementing Set Shoes, Type T, V K&K Modified", 72 pages.

(List continued on next page.)

*Primary Examiner*—Terry Lee Melius
*Assistant Examiner*—Gary S. Hartmann
*Attorney, Agent, or Firm*—Matthews, Joseph, Shaddox & Mason, P.L.L.C.

[57] ABSTRACT

A system for reducing pressure while running a casing liner, hanging a casing liner from a casing and cementing the liner in a borehole during a single trip downhole is disclosed. Some of the components of the system are 1.) a bypass or diverter sub for reducing surge pressure having either an incremental breakaway seat or a yieldable seat, 2.) a container or manifold for launching a smaller ball used to close the bypass, a larger ball used to hang the liner in the casing, and a drill pipe wiper dart for cementing, and 3.) a guide shoe with multiple openings and no float valve to provide proper flow of drilling fluid up the liner and out the port of the bypass to reduce surge pressure and to provide for proper cementation. Advantageously, methods for operation of this surge pressure reduction system and its components are also disclosed.

61 Claims, 10 Drawing Sheets

U.S. PATENT DOCUMENTS

| | | | |
|---|---|---|---|
| 5,388,930 | 2/1995 | McNease | 405/209 |
| 5,419,657 | 5/1995 | Davis | 405/209 |
| 5,421,408 | 6/1995 | Stoisits et al. | 166/274 |
| 5,443,122 | 8/1995 | Brisco | 166/285 |
| 5,499,687 | 3/1996 | Lee | 175/317 |
| 5,553,667 | 9/1996 | Budde et al. | 166/70 |
| 5,641,021 | 6/1997 | Murray et al. | 166/291 |
| 5,722,491 | 3/1998 | Sullaway et al. | 166/291 |

OTHER PUBLICATIONS

Brown Oil Tools, Inc. General Catalog, 1972–1973, front and rear covers and pp. 714–784, in particular, see pages 762 and 763, 72 pages.

Brown Oil Tools, Inc. General Catalog, 1974–1975, front and rear covers and pp. 746–816, in particular, see pages 792 and 793, 72 pages.

Brown Oil Tools, Inc. General Catalog, 1976–1977, front and rear covers and pp. 857–904, in particular, see pages 900 and 902, 50 pages.

Brown Oil Tools, Inc. General Catalog, 1982–1983, front cover and pp. 1410–1440, 32 pages.

Brown Oil Tools, Inc. General Catalog, 1986–1987, front cover and pp. 3052–3072, in particular, see pp. 3070 and 3071, 22 pages.

Baker Oil Tools, Inc. Catalog, 1962, front cover and pp. 461–466, 7 pages.

Baker Oil Tools, Inc. Catalog, 1966–1967, front cover and pp. 502–504, 5 pages.

Baker Oil Tools, Inc. Catalog, 1970–1971, front cover and pp. 580–596, 19 pages.

Baker Oil Tools, Inc. Catalog, 1972–1973, front cover and pp. 356–376, 22 pages.

Baker Oil Tools, Inc. Catalog, 1974–1975, front cover and pp. 324–348, 26 pages.

Baker Oil Tools, Inc. Catalog, 1976–1977, front cover and pp. 396–418, 25 pages.

Baker Oil Tools, Inc. Catalog, 1982–1983, front cover and pp. 662–680, 22 pages.

Baker Oil Tools, Inc. Product Guide, 1986–1987, pp. 321, 336–337, 3 pages.

Baker Service Tools Mini Catalog, 1986–1987, pp. 373–374, 2 pages.

Baker Oil Tools—Retrievable Packer Systems—Model "E"™ Hydro–Trip Pressure Sub Product No. 799–28, Specification Guide, p. 53, 1 page.

Lindsey Completion Systems General Catalog, 1986–1987, front cover and rear cover and pp. 4246–4275, in particular, p. 4260 re "Cementing Euipment—Manifold", 32 pages.

Texas Iron Works Catalog, 1962–1963, front cover and pp. 4902–4903, 3 pages.

Texas Iron Works Catalog, 1966–1967, front cover and pp. 4802–4803, 3 pages.

Texas Iron Works Catalog, 1970–1971, front cover and p. 4612, 2 pages.

Texas Iron Works Catalog, 1972–1973, front cover and p. 4330, 2 pages.

Texas Iron Works Catalog, 1974–1975, front and rear covers and pages 4918–4955, in particular, p. 4947 "TIW Cementing Manifolds", 40 pages.

Texas Iron Works Catalog, 1976–1977, front cover and p. 5544, 2 pages.

Texas Iron Works Catalog, 1982–83, front and rear covers and pp. 7910–7951 in particular, p. 7922 for "TIW Cementing Equipment", 44 pages.

Texas Iron Works Catalog, 1986–1987, front and rear covers and pp. 6090–6152, in particular, p. 6106 for "Cementing Equipment", 64 pages.

TIW Liner Equipment, Mechanical–Set Liner Hangers Specifications, pp. 12 or 2838 (prior art), 1 page.

TIW Marketing Application Drawing, 1724.01 Mech EJ–IB–TC RHJ Liner Hanger, Pin–up Class (prior art), 1 page.

Davis Manual–Fill Float Shoes, pp. 868 to 870 (prior art), 3 pages.

Davis Self–Filling Float Shoes and Float Collars, pp. 872, 873 (prior art), 2 pages.

Ray Oil Tool Company Introduces, Another Successful Tool: Intercasing Centralizers (Inline Centralizers), Lafayette, Louisiana (prior art), 7 pages.

TIW, Liner Equipment, Hydro–Hanger specifications p. 2837 and, 1718.02 IB–TC R HYD HGR W/PIN TOP (prior art), 2 pages.

Weatherford Gemoco, ©Weaterford 1993, Model 1390 and 1490 Float Shoe Sure Seal Auto Fill, May 10, 1994, 8 pages. Note patent pending on last page.

TIW Corporation, Marketing application Drawing, 0758.05 Circulating Sub (prior art), 1 page.

TIW Corporation, Marketing application Drawing, 1718.02 IB–TC R HYD HGR W/PIN TOP (prior art), 1 page.

Downhole Products, The Spir–O–Lizer™ (Patented), (Represented in North America by Turbeco Inc., 7030 Empire Central Drive, Houston, Texas 77040) (prior art), 7 pages.

SPE Drilling & Completion, Dec. 1996, Copyright 1996 Society of Petroleum Engineers, Zonal Isolation and Evaluation for Cemented Horizontal Liners, pp. 214–220; Turbeco, Inc. Spir–O–Lizer Products Job Log, 2 pages; Downhole Products PLC Spir–O–Lizer Products Job Log, 8 pages front and back; Spir–O–Lizer Technical Information and Price List, 1 page.

Halliburton Services, RTTS Circulating Valve, 3 pages; RTTS Equipment, Operating Procedure (prior art), 2 pages.

TIW Liner Equipment, Setshoes, Type LA Setshoe; Type LA–2 Setshoe; Type CLS–2 Shetshoe; and Type CB–2 Setshoe, p. 23 (prior art), 1 page.

TIW Corporation, Marketing application Drawing, 1904.01 Fillup Setshoe (prior art), 1 page.

TIW Liner Equipment, Liner Float Equipment, C–LF Lading Collar; Regular Landing Collar; HS–SR Landing Collar with Ball–and–Seat Shear Assembly; and C Float Collar, p. 22 (prior art), 1 page.

TIW Corporation, Marketing application Drawing, 1816.01 PDC L Landing Collar w/ Anti–Rotation Clutch (prior art), 1 page.

Davis Cementing Enhancement Devices, Davis Non–Welded Semi–Rigid Centralizer (SRC); Davis Non–Welded Rigid Centralizer; and Centralizer Comparison Chart, p. 16 (prior art), 1 page.

Varco, B.J. Drilling Systems Reference Drawing Sheets, TDS–6S Block Dolly; TDS–6S Guide Dolly; and Crank Assy Installation (prior art), 6 pages.

A Model "E" "Hydro–Trip Pressure Sub" No. 799–28, distributed by Baker Oil Tool, a Baker Hughes Company of Houston, Texas, is installable on a string below a hydraulically actuated tool, such as hydrostatic packer to provide a method of applying the tubing pressure required to actuate the tool. To set a hydrostatic packer, a ball is circulated through the tubing and packer to the seat in the "Hydro–Trip Pressure Sub", and sufficient tubing pressure is applied to actuate the setting mechanism in the packer. After the packer is set, a pressure increase to approximately 2,500 psi (17, 23MPa) shears screws to allow the ball seat to move downs until fingers snap back into a groove. The sub then has a full opening, and the ball passes on down the tubing, as discussed in the Background of the Invention of the present application. (See "R" above).

No. 0758.05 sliding sleeve circulating sub or fluid bypass manufactured by TIW Corporation of Houston, Texas (713) 729–2110 used in combination with an open (no float) guide shoe, as discussed in the Background of the Invention of the present application. (See "II" above).

Halliburton RTTS circulating valve, distributed by Halliburton Services. The RTTS circulating valve touchs on bottom to be moved to the closed port position, i.e. the J–slot sleeve needs to have weight relieved to allow the lug mandrel to move. The maximum casing liner weight that is permitted to be run below the Halliburton RTTS bypass is a function of the total yield strength of all the lugs in the RTTS bypass which are believed to significantly less than the rating of the drill string, as discussed in the Background fo the Invention of the present application. (See "MM" above).

A Primer of Oilwell Drilling by Ron Baker, Published by Petroleum Extension Service, The University of Texas at Austin, Austin, Texas in cooperation with International Association of Drilling Contractors, Houston, Texas 1979, cover page and pp. 56–64, 10 pages.

Schlumberger Dowell brochure—Don't let cementing in deepwater put your well at risk, 5 pages.

Connect Schlumberger Homepage, Connect Schlumberger Log–in, Jul. 23, 1997, 2 pages. Schlumberger Limited, Welcome to Schlumberger, 2 pages. Search the Schlumberger Server, 1 page. Excite for Web Servers Search Results, Jul. 23, 1997, 4 pages. Excite for Web Servers Search Results, Jul. 24, 1997, 4 pages.

"DeepSea EPRES*—Dowell developed the EXPRES concept of preloading casing wiper plugs inside a basket several years ago. Expanding this approach to subsea cementing greatly simplifies plug design. By also utilizing three darts and three plugs rather than a ball, a system had been devised that provides: Enhanced reliability, Improved job quality, Reduced rig time" Jul. 23, 1997, 1 page.

DeepSea EPRES—Surface Dart Launcher (SDL), Jul. 23, 1997, 2 pages.

DeepSea EXPRES—Subsea Tool (SST), Jul. 24, 1997, 2 pages.

SCR Patent 1987–1996—Schlumberger Cambridge Research by Author, Jul. 24, 1997, 8 pages.

CD Rom–DeepSea Express—Interactive Multimedia Presentation Version 1.0 TSL–4191 *Mark of Schlumberger.

DOWNHOLE SURGE PRESSURE REDUCTION SYSTEM AND METHOD OF USE

BACKGROUND OF THE INVENTION

1.) Field of the Invention

This invention relates to a downhole surge pressure reduction system for use in the oilwell industry. In a particular application, this invention relates to a system for reducing surge pressure while running a casing liner downhole, hanging the casing liner on casing, and cementing the casing liner in the borehole. Advantageously, this system, in one application, may be used in a method for reducing of surge pressure, hanging and cementing of the casing liner in a single trip downhole. The fluid bypass used in the system and method includes a replaceable breakaway seat.

2.) Description of the Related Art

For a long time, the oilwell industry has been aware of the problem created when lowering a drill string at a relatively rapid speed in drilling fluid. This rapid lowering of the drill string results in a corresponding increase or surge in the pressure generated by the drilling fluid in the annulus between the drill string and the casing, and the drill string and the exposed formation about the borehole. Of particular concern is the exposed formation.

This surge pressure has been problematic to the oilwell industry in that it has many detrimental effects. Some of these detrimental effects are 1.) loss volume of drilling fluid, which presently costs $40 to $400 a barrel depending on its mixture, that is primarily lost into the earth formation about the borehole, 2.) resultant weakening and/or fracturing of the formation when this surge pressure in the borehole exceeds the formation fracture pressure, particularly in older formations and/or permeable (e.g. sand) formations, 3.) loss of cement to the formation during the cementing of the casing finer in the borehole due to the weakened and, possibly, fractured formations resulting from the surge pressure on the formation, and 4.) differential sticling of the drill string or casing liner being run into a formation during oilwell operations, that is, when the surge pressure in the borehole is higher than the formation fracture pressure, the loss of drilling fluid to the formation allows the drill string or casing liner to be pushed against the permeable formation downhole and allows it to become stuck to the permeable formation.

This surge pressure problem has been further exasperated when running tight clearance casing liners or other apparatus in the existing casing. For example, the clearances in recent casing liner runs have been ½" to ¼" in the annulus between the casing liner and casing. This reduction in the annulus area in these tight clearance casing liner runs have resulted in corresponding higher surge pressure and heightened concerns over their resulting detrimental effects.

The most common known response to these surge pressures is to decrease the running speed of the drill string or casing liner downhole to maintain the surge pressure at an acceptable level. An acceptable level would be a level at least where the drilling fluid pressure, including the surge pressure, is less than the formation fracture pressure to minimize the above detrimental effects. However, as can now be seen, any reduction of surge pressure would be beneficial as the more surge pressure is reduced, the faster the drill string or casing liner could be run. Time is money, particularly on the expensive offshore rigs, such as, those disclosed, but not limited to, in U.S. Pat. Nos. 4,130,503; 4,916,999; 5,290,128; 5,388,930; and 5,419,657, that are assigned to the assignee of the present invention and incorporated by reference herein for all purposes.

As used herein, a drill stem is the entire length of tubular pipes, composed of the kelly, the drill pipe and drill collars, that make up the drilling assembly from the surface to the bottom of the borehole. A drill string is defined herein as the columns or string of drill pipe, not including the drill collars or kelly. The drill pipe or pipe is defined herein as a heavy seamless tubing used to rotate the bit or other tools, run casing liner or other apparatus, or circulate the drilling fluid. Joints of pipe 30 ft. long are coupled together by means of tool joints. By connecting three lengths of pipes, a stand of pipe 90 ft. long is created. As used herein, casing is steel pipe placed in an oil or gas well as drilling progresses to prevent the borehole from caving during drilling and to provide means of extracting petroleum, if the well is productive. A casing liner or liner, as defined herein, is any casing whose top is located below the surface elevation. Finally, a casing liner hanger is a slip device, including, but not limited to, hydraulic and mechanical casing liner hangers, that attaches the casing liner to the casing.

Downhole tools now exist that aid in reducing surge pressure but the inventors are not aware of any tool that satisfies the need of a system and method for reducing surge pressure, allows torsional rotation of the drill pipe, can be cycled from open to close while in tension, provides full opening and allows hanging and cementing of a casing liner in a single trip downhole.

For example, U.S. Pat. No. 2,947,363, assigned on its face to Johnson Testers, Inc., proposes a fill-up valve for well strings that includes a movable sleeve in a housing. As taught by the '363 patent, after a predetermined amount of fluid has been admitted, a ball is dropped on the sleeve and pressure applied to move the sleeve downwardly to misalign the ports to a closed port position. Fingers on the sleeve are stated to interlock with teeth to stop upward movement of the sleeve. While the ball could be moved up the housing by an upward flow of pressurized fluid, the ball cannot be blown or forced downwardly through the sleeve. Therefore, this Johnson Testers' fill-up valve does not provide full opening for inner drill string work to be accomplished at a depth below the fill-up valve.

U.S. Pat. No. 3,376,935, assigned on its face to the Halliburton Company, proposes a well string that is partially filled with fluid during a portion of its descent into a well and, thereafter, selectively closed against the entry of further fluid while descent of the well string continues ('935 patent, col. 1, ins 25 to 47). As best shown in FIGS. 3 to 5 of the '935 patent, a ball seats on a ball seat to move the sleeve downwardly to a closed port position. Upon a predetermined pressure the seat deforms, as shown in FIG. 5, to allow the ball to pivot the flapper valve 17 downwardly and pass out of the housing 3 ('935 patent, col. 6, Ins 32 to 60). The flapper check valve 17 prevents flow of fluid (e.g. drilling fluid) up through the housing ('935 patent, col. 4, ins 60 to 73), whether or not the sleeve is in the open port position (FIG. 3) or the closed port position (FIGS. 2, 4 and 5). Additionally, as best shown in FIGS. 1 and 2, the inside diameter of the sleeve is less than the inside diameter of the drill string 2 or pipe interior 6, thereby creating a restriction in the string 2. While this Hamburton tool allows movement of fluids from the annulus, adjacent the ports 13 of the tool, to flow up the drill string, the surge pressure created by apparatus uses, below the tool, is not alleviated.

U.S. Pat. No. 4,893,678, assigned on its face to Tam International, proposes a multiple-set downhole tool and method of use of the tool. While confirming the oilwell industry desire for "full bore" opening in downhole equipment, the '678 patent proposes the use of a ball to move a sleeve to misalign a port in the sleeve and a passage in the housing. Additionally, while the ball can even be "blown out" (FIG. 5), the stated purpose of the apparatus in the '678 patent is to activate a tool, and more particularly, to inflate an elastomeric packer ('678 patent, col. 1, ins 20 to 25 and col. 3, in 14 to col. 4, In 42), not to reduce surge pressure while running a drill string with a casing liner packer or other apparatus downhole.

A Model "E" "Hydro-Trip Pressure Sub" No. 799-28, distributed by Baker Oil Tools, a Baker Hughes company of Houston, Tex., is installable on a string below a hydraulically actuated tool, such as a hydrostatic packer to provide a method of applying the tubing pressure required to actuate the tool. To set a hydrostatic packer, a ball is circulated through the tubing and packer to the seat in the "Hydro-Trip Pressure Sub", and sufficient tubing pressure is applied to actuate the setting mechanism in the packer. After the packer is set, a pressure increase to approximately 2,500 psi (17,23 MPa) shears screws to allow the ball seat to move down until fingers snap back into a groove. The sub then has a full opening, and the ball passes on down the tubing. U.S. Pat. No. 5,244,044, assigned on its face to Otis Engineering Corporation of Dallas, Tex., proposes a similar catcher sub using a ball to operate pressure operated well tools in the conduit above the catcher sub. However, neither the Baker or Otis tools provide for reduction of surge pressure by diverting fluid flow into the annulus between the drill pipe and casing.

Many attempts have been made to try and solve the surge pressure problem. Over a year before the filing of the present application, a Davis Type PVTS automatic fill float equipment was used when running a casing liner in an attempt to reduce surge pressure. Unlike standard no-fill float equipment, automatic fill float equipment allows drilling fluid to travel up inside the casing liner and the drill string. However, automatic fill float equipment does have its limitations. Although it reduces surge pressure, it does not allow for maximum running speeds. Additionally, if flow up an automatic fill float equipment reaches a predetermined value, such as in this case 1.6 bbl/min., the automatic fill feature is converted to no-fill. Upon conversion, with no means of reducing surge pressure, drilling fluid was lost to the formation, resulting in the eventual differential stickling of the casing liner.

Subsequent runs in the fall-winter of 1996, also failed to identify a method of successfully reducing surge pressure while running a casing liner and to provide an adequate means of cementation. For example, a No. 0758.05 sliding sleeve circulating sub or fluid bypass manufactured by TIW Corporation of Houston, Tex. (713) 729-2110 was used in combination with an open (no float) guide shoe.

The next attempt at reducing surge pressure while running a casing liner was made upon locating another bypass, the Halliburton RTTS circulating valve, distributed by Halliburton Services. The RTTS circulating valve, however, needed to touch on bottom to be moved to the closed port position, i.e. the J-slot sleeve needs to have weight relieved to allow the lug mandrel to move. The maximum casing liner weight that is permitted to be run below the Halliburton RTTS bypass is a function of the total yield strength of all the lugs in the RTTS bypass which are believed to significantly less than the rating of the drill string. However, this casing liner became plugged when set on bottom to facilitate closure of the bypass. Attempts were made to unplug the guide shoe, which resulted in the accidental setting of the hydraulic casing liner hanger Once again, a normal cement job was not possible, and a total of 180 hours of offshore rig time, and other costs were lost. A second run of the Halliburton fluid bypass, this time with multiple openings in the float shoe at the bottom end of the casing liner and with the float removed to reduce chances of plugging, was performed. While the second Halliburton fluid bypass run was successful in reducing surge pressure, reducing connection time, and resulted in a normal cementing of the casing liner, the concerns of future applications were apparent. The next scheduled casing liner run would require that the system be washed and reamed in the hole. This would require a bypass which could be subjected to rotational torque while also being in a compressive load state. While the TIW No. 0758.05 bypass can be rotated, both the TIW No. 0758.05 bypass and Halliburton RTTS bypass must be closed by setting on bottom. In other words, the TIW No. 0785.05 bypass and Halliburton RTTS bypass can not be closed while in tension.

Also, page 3071 of publication entitled "Brown Hughes, Hughes Production Tools Liner Equipment" and page 900 of Brown Oil Tools, Inc. General Catalog 1976–1977 disclose a Brown type circulating valve using setdown weight to move to a closed port position.

In particular, a system and method that allows 1.) a minimum of surge pressure to be placed on the formation, 2.) a drill string, casing liner or other downhole tools to be run with a minimum of time sitting on the slips during connections, 3.) washing and reaming with the casing liner in an unstable wellbore, 4.) normal drilling fluid path circulation achieved without risk or plugging the bottom of the drill string or casing liner by touching it on bottom, 5.) a normal cement job to be performed, and 6.) material and time savings resulting from above would be highly desired by the oilwell industry.

Furthermore, in the past there have been devices for releasing multiple balls into a downhole pipe, such as, U.S. Pat. Nos. 2,737,244; 3,039,531; 3,403,729; 4,033,408; 4,132,243; and 5,499,687. Also, in the past there have been devices for releasing a cement plug in downhole pipe, such as, disclosed on page 4947 of the TIW catalog 1974–1975; page 7922 of the TIW catalog 1982–1983; page 6106 of the TIW catalog 1986–1987 (the TIW devices on pages 7922 and 6106 states that they can provide a ball dropping sub for setting the TIW "HYDRO-HANGER" when necessary). Also, a bypass line for a cementing manifold that can be fitted with a ball dropping sub for use with a hydraulic casing liner hanger has been proposed on page 4260 of publication entitled "Lindsey Completion Systems 1986–1987 General Catalog". Also, a combination cement plug dropping head and swivel has been known, such as, disclosed on page 3070 of publication entitled "Brown Hughes, Hughes Production Tools liner Equipment" and page 902 of Brown Oil Tools, Inc. General Catalog 1976–1977.

However, a launching manifold additive to a top drive, such as a pipehandler PH-85 650/750 for a TDS manufactured by Varco, B. J. Drilling Systems, suspended from a traveling block for the above desired system for use in closing a flow port used for reducing surge pressures, hanging and cementing the casing liner in the borehole would be desirable. In particular, a launching manifold for interchangeable use with a top drive or kelly that would hold and release two balls, and a drill pipe wiper dart and that also includes a drilling fluid bypass path in order to wash and ream without disconnection from the top drive and drill string would be desirable.

SUMMARY OF THE INVENTION

A system for reducing surge pressure while running a casing liner, hanging a casing liner from a casing and cementing the casing liner in a borehole during a single trip downhole is provided. Some of the components of the system are 1.) a fluid bypass or diverter sub for reducing surge pressure having either an incremental breakaway seat or yieldable seat, 2.) a container or manifold for launching a smaller ball used to close the fluid bypass, a larger ball used to hang the casing liner in the casing, and a drill pipe wiper dart for cementing that minimizes connection time while facilitating washing and rotation, and 3.) a guide shoe with multiple openings and no float valve to provide for proper flow of drilling fluid up the casing liner and out the port of the fluid bypass to reduce surge pressure and to provide for proper cementation. Advantageously, methods for operation of this surge pressure reduction system and its components are also provided.

BRIEF DESCRIPTION OF THE DRAWINGS

The objects, advantages and features of the invention will become more apparent by reference to the drawings which are appended hereto, wherein like numerals indicate like parts and wherein an illustrated embodiment of the invention is shown, of which.

DETAILED DESCRIPTION OF THE PREFERRED EMBODIMENT

Figure 1:
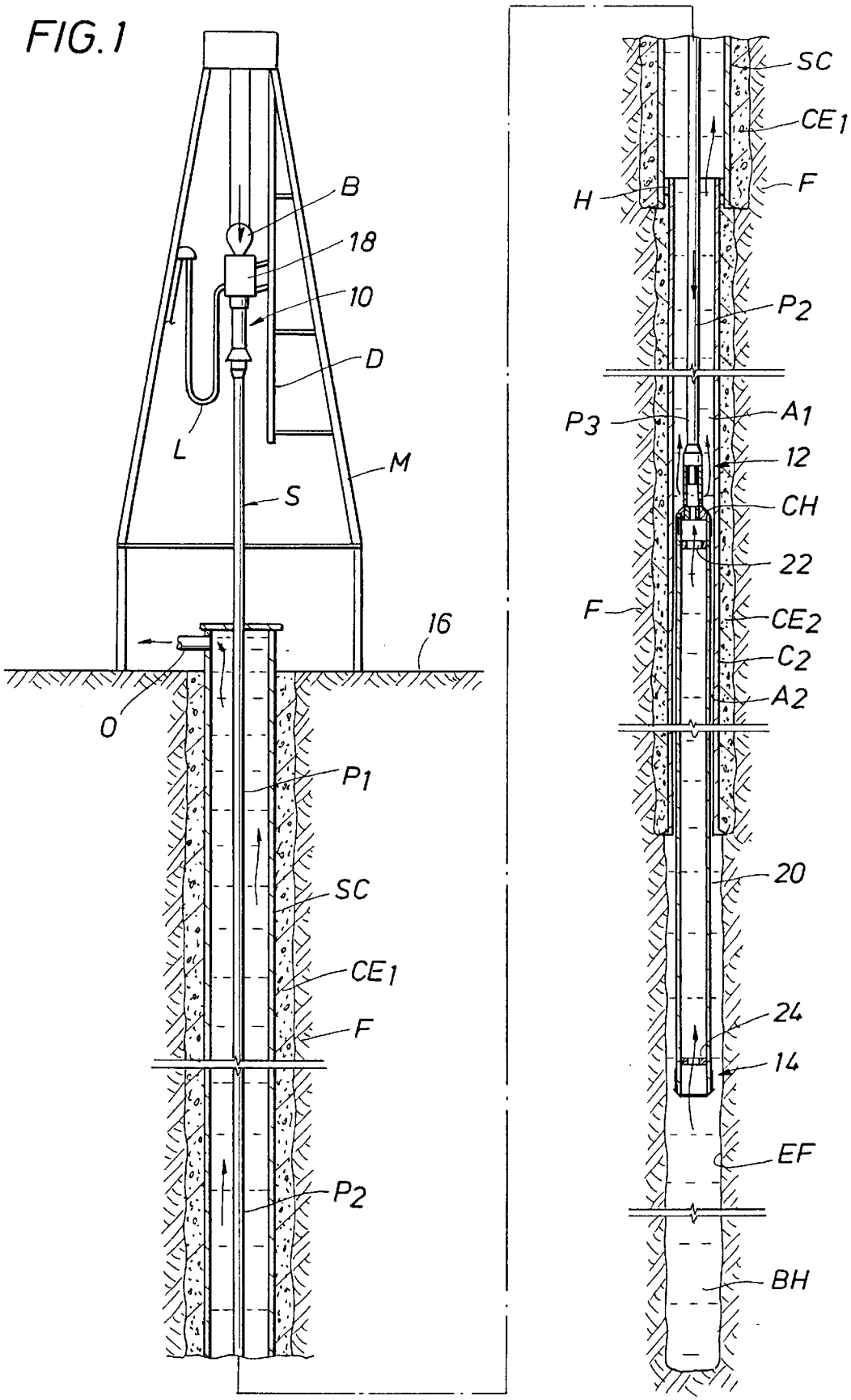
FIG. 1 is an elevational view of the system of the present invention for running of a casing liner downhole, with the launching manifold or container connected to a top drive, shown in full view, and the bypass or diverter sub, casing liner and guide shoe shown in section view.
Figure 20:
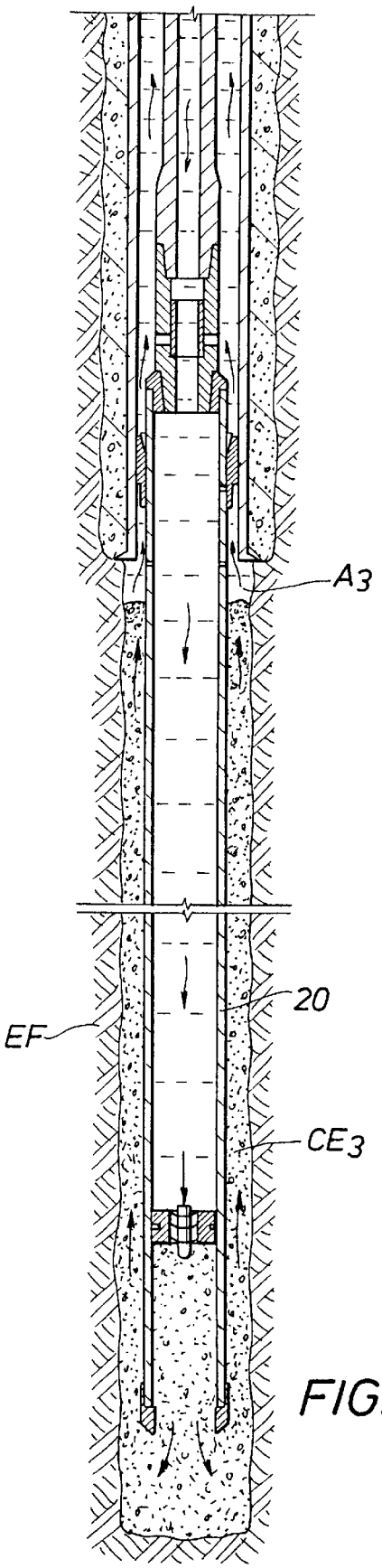
FIG. 20 is an elevational view of the drill pipe wiper dart after seating in the casing liner cement wiper plug, as shown in FIG. 19, with the drill pipe wiper dart moving with the casing liner cement wiper plug to further move the cement out of the casing liner into the annulus between the casing liner and the borehole.
Figure 21:
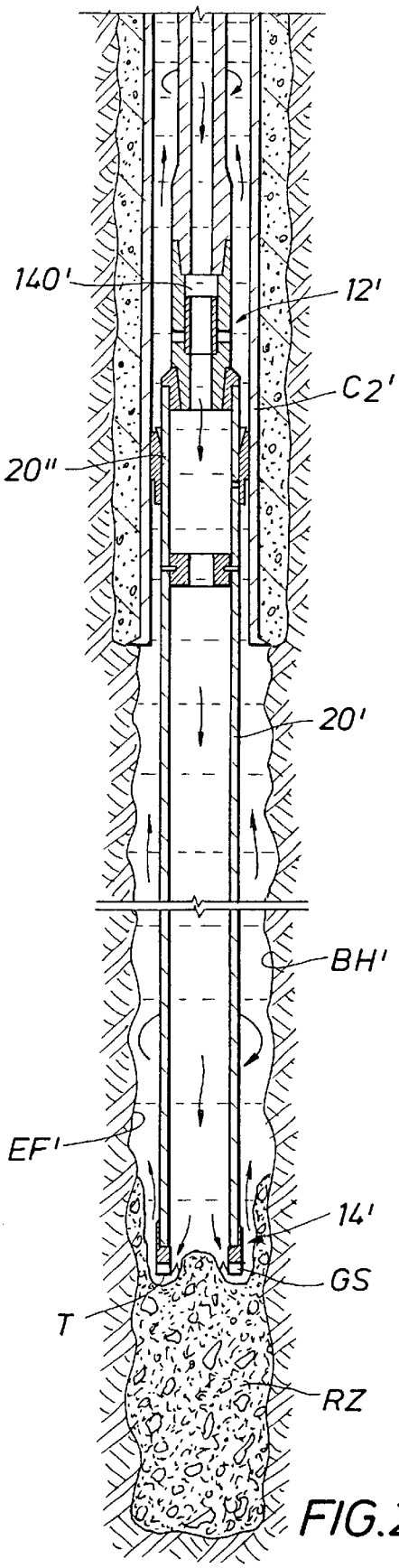
FIG. 21 is an embodiment of the guide shoe, in a view similar to FIG. 1, where the present invention is used for rotating a casing liner having a guide shoe with teeth at its end for reaming rubble while washing the rubble up the annulus.

The preferred embodiment of the system and method of the present invention are illustrated in FIGS. 1 and 20, an application using a special guide shoe of the present invention is shown in FIG. 21.

Generally, as shown in FIG. 1, some of the components of the system of the present invention are 1.) the launching manifold, generally indicated at 10, 2.) the bypass, generally indicated at 12, and 3.) the guide shoe, generally indicated at 14. While the mast M of FIG. 1 is illustrated on surface 16, the mast M could be located on an offshore rig, such as those disclosed, but not limited to, in U.S. Pat. Nos. 4,103,503; 4,916,999; 5,290,128; 5,388,930; and 5,419,657, assigned to the assignee of the present invention and incorporated by reference herein for all purposes.

As shown in FIG. 1, the mast M suspends a traveling block B, which supports a top drive 18, such as manufactured by Varco B. J. Drilling Systems, that moves vertically on the TDS-65 block dolly D, as is known by those skilled in the art. An influent drilling fluid line L connects the drilling fluid reservoir (not shown) to the top drive 18.

Though a kelly, a kelly bushing and a rotary table are not shown, the launching manifold 10 is designed to alternatively be connected in that configuration for launching.

Figure 2:
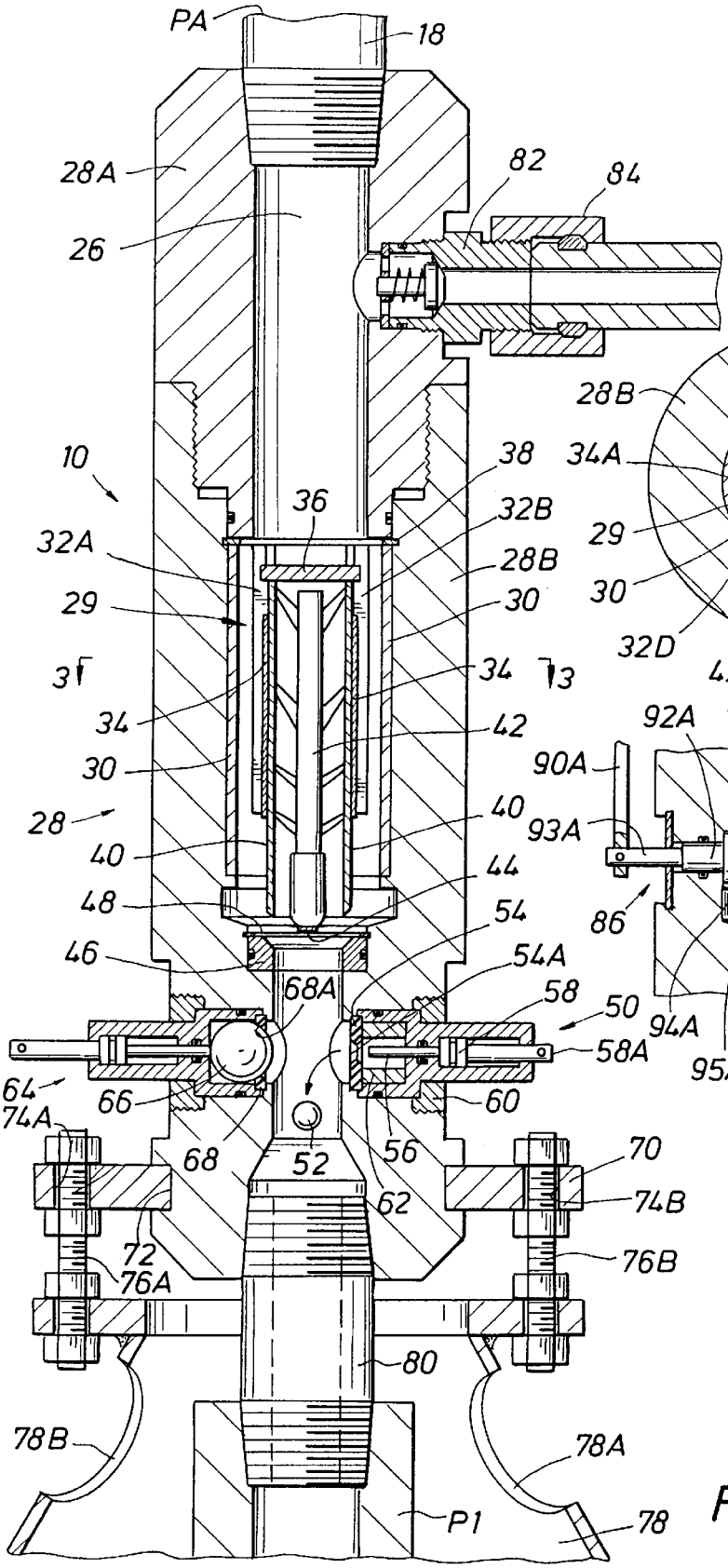
FIG. 2 is an enlarged view of the preferred embodiment of the launching manifold of FIG. 1 with the container shown in section view to better illustrate the releasable holders for the two balls and dart.

As best shown in FIGS. 1 and 2, the launching manifold 10 can remain connected to the top drive 18 during the launching of both of the balls and dart while washing and reaming, as will be discussed below in detail. The bottom of the manifold 10 is stabbed or threaded into a drill string, generally indicated at S, comprising a plurality of drill pipes $P_1$, $P_2$, $P_3$. The number of pipes or stands of pipes used will, of course, depend on the depth of the well.

The bypass 12 is threadedly connected between the lowermost joint of pipe $P_3$ and the casing hanger CH, as will be discussed in detail below. The open guide shoe, generally indicated at 14, preferably does not have any float valve and includes multiple openings, is secured to the bottom of the casing liner 20. Preferably, a device resulting from a Davis Type 505AF shoe with the flap removed and with multiple openings in its side is used. However, other shoes, such as the Model 1390 float shoe with its valve removed and multiple openings in its side, distributed by Weatherford-Gemoco of Houma, La., could be used.

The surface casing SC is encased by solidified cement $CE_1$, in the formation F and includes an opening O adjacent its top for controlled return of drilling fluid from up the annulus between the pipe $P_1$ and the casing SC An intermediate casing liner $C_2$, encased by solidified cement $CE_2$ in the formation F, is hung from the casing SC by either a mechanical or hydraulic hanger H.

The casing liner 20 includes a casing liner wiper plug 22 and a casing liner landing collar 24, that will be discussed below in detail. A preferred casing liner landing collar 24 is a HS-SR (FIG. 502) landing collar, distributed by TIW of Houston, Tex. However, other collars, such as the Model 1490 collar with its valve removed, distributed by Weatherford-Gemoco of Houma, La., could be used. The inside diameter of collar 24 is approximately 2.6". As can be seen in FIG. 1, the annulus $A_1$ between the pipe $P_3$ and the casing $C_2$ is greater in area than the annulus $A_2$ between the casing liner 20 and the casing $C_2$. While the invention is not contemplated to be limited to use in tight or close clearance casing liner runnings, the benefits of the present invention are more pronounced in tight clearance running, since as the area is reduced the pressure (pressure is equal to weight/area) is increased. Additionally, it is believed that other apparatus, such as packers and other tools, run using the present invention would obtain the benefits of the present invention.

Figure 3:
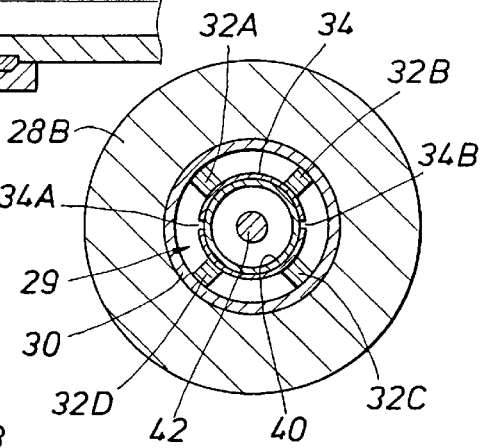
FIG. 3 is a section view taken along lines 3—3 of FIG. 2.

Turning now to FIG. 2, the preferred launching manifold 10 of FIG. 1 is shown threadedly connected between the top drive 18 and pipe $P_1$ of drill string S. The drilling fluid line L provides drilling fluid in passage PA to flow passage 26. The manifold 10 includes a container, generally indicated at 28, having a top portion 28A threadedly connected to a bottom portion 28B. As best shown in FIGS. 2 and 3, the container bottom portion 28B is sized to receive a dart assembly, generally indicated at 29, including a jacket 30 having four equidistant spaced members 32A, 32B, 32C and 32D fixedly connected to a cylinder 34. Horizontal plate 36 is removably positioned on shoulders of members 32A, 32B, 32C and 32D. As best shown in FIGS. 2 and 3, the dart assembly 29 is removable from the container bottom portion 28B by unthreading the top portion 28A from the bottom portion 28B and removing snap ring 38. The replaceability of the dart assembly 29 will reduce manufacture and inventory cost.

Figure 4:
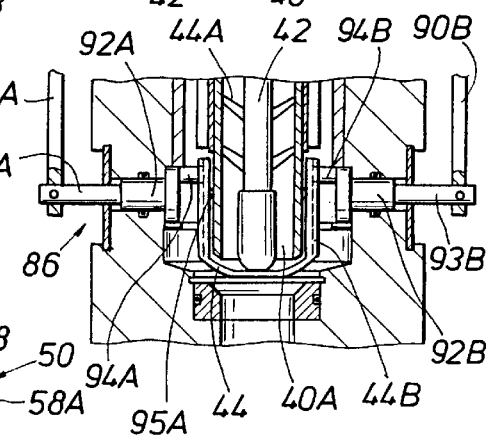
FIG. 4 is partial view of FIG. 2 rotated 90° to better illustrate the releasable dart holder.
Figure 5:
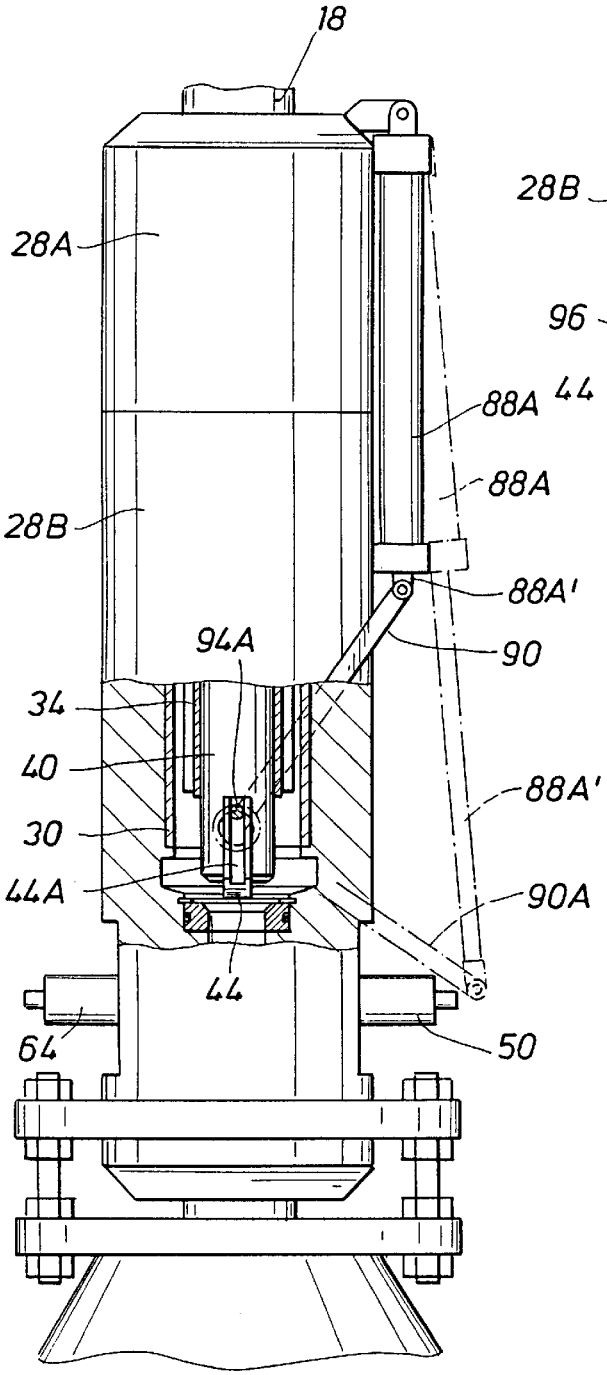
FIG. 5 is an elevation view of the preferred embodiment of the launching manifold as shown in FIG. 2, partially broken away, with hydraulic actuation shown, in solid lines, in the fluid flow position and, in phantom lines, in the dart actuation position.
Figure 7:
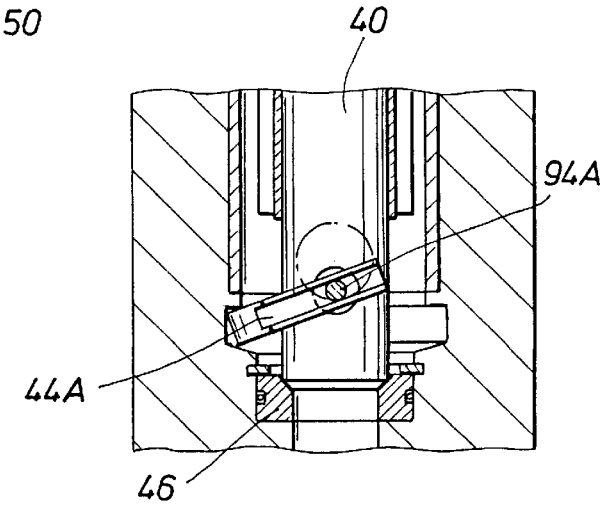
FIG. 7 is a view similar to FIG. 6 with the dart sleeve shown sealed with the seat in the dart actuation position.
Figure 8:
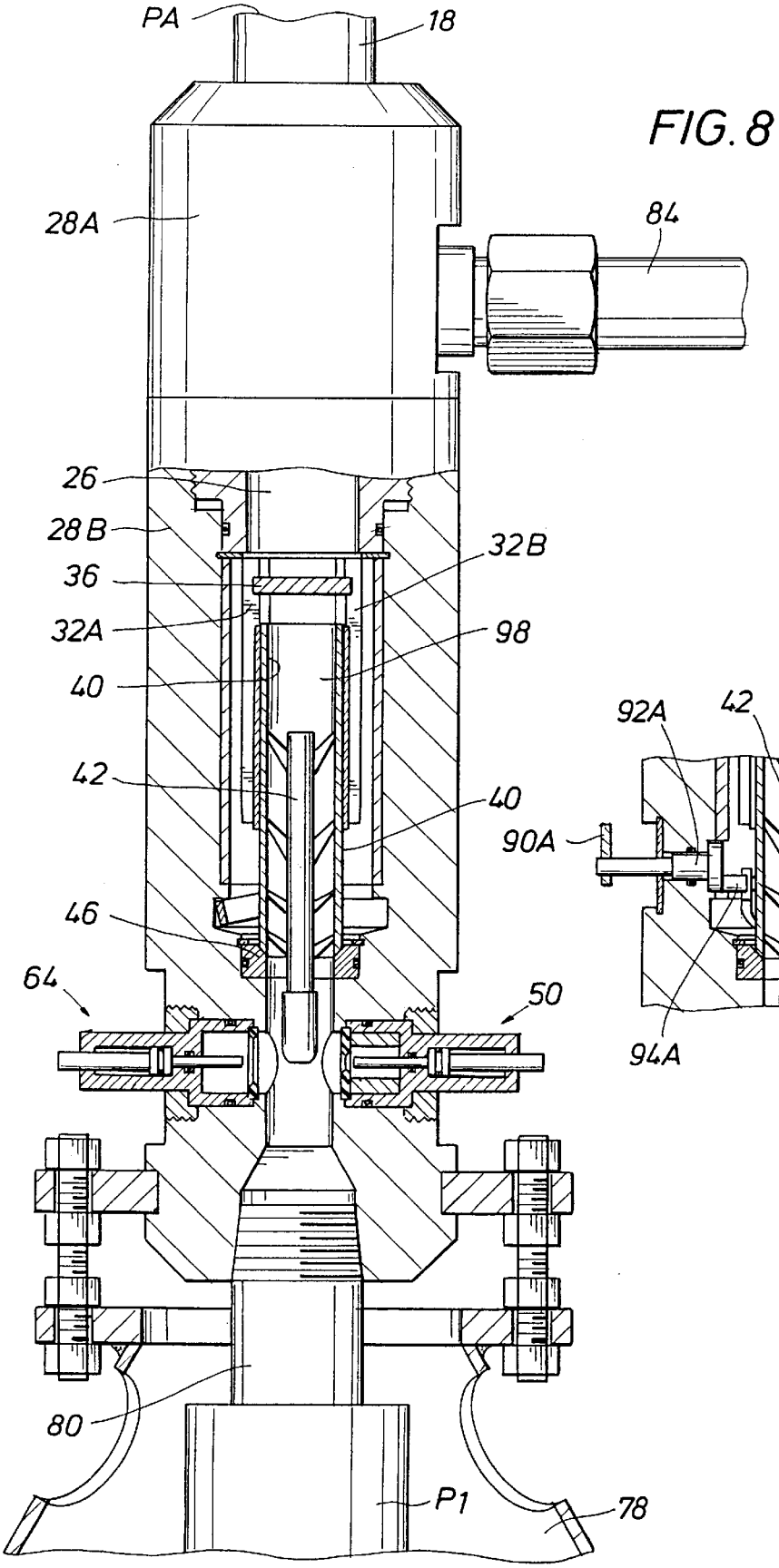
FIG. 8 is a view similar to FIG. 2 with the releasable dart holder and the dart sleeve shown in the dart actuation position so that drilling fluid can be received into the dart sleeve to move the dart down into the drill pipe.
Figure 9:
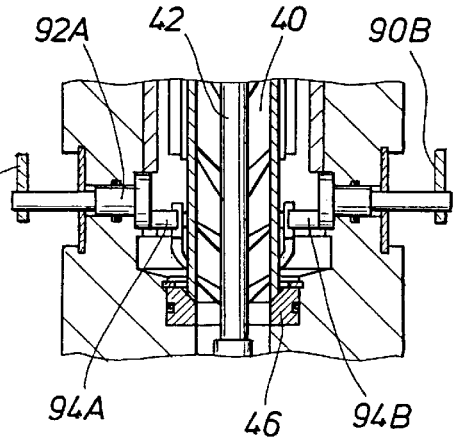
FIG. 9 is a partial view of FIG. 8 rotated 90° to better illustrate the releasable dart holder and dart sleeve in the dart actuation position.

As best shown in FIG. 3, cylinder 34 has two vertical slots 34A, 34B to allow the dart sleeve 40 and pivotly attached U-shaped holding member 44 to slide up out of cylinder 34. A wiper dart 42 is positioned in dart sleeve 40 to rest on the dart U-shaped holding member 44. When plate 36 is removed, dart sleeve 40, dart 42 and U-shaped holding member 44 can be slidably removed from cylinder 34. In particular, the vertical slots 34A, 34B provide clearance for the U-shaped holding member 44 to slide out of cylinder 34. As can now be understood, it is not necessary to remove snap ring 38 or dart assembly jacket 30, members 32A, 32B, 32C and 32D, and cylinder 34 to remove or install the dart sleeve 40 and/or dart 42. The dart sleeve 40 can then be moveably positioned between a fluid flow position, as shown in FIGS. 2, 4 and 5, and a dart actuation position, as shown in FIGS. 7, 8 and 9. One example for a wiper dart that could be used is the TIW pump down plug No. 2000.01 available from TIW Corporation of Houston, Tex.

The container bottom portion 28B further includes a replaceable soft seat 46 removably positioned on an upwardly facing shoulder in the bottom portion 28B. Though seat 46 is shown held in position by snap ring 48, preferably seat 46 is press fit into and press removed from bottom portion 28B, therefore, eliminating the need for snap ring 48.

The container 28 further includes a holding member, generally indicated at 50, for holding the smaller ball 52. The holding member 50 includes an elastomer member 54 having a circular opening 54A sized to allow release of the ball 52 when urged by rod 56 connected to piston 58. As can now be seen, the rod 56 can be remotely pneumatically or hydraulically to urge the ball 52 to past the elastomer member 54 and down the pipe $P_1$. Alternatively, a hammer (not shown) could be used to strike the end 58A to manually move the rod 56 inwardly. Threaded member 60 is used to removably position the holding member 50 in the side of the container 28. A centering member 62 is provided in holding member 50 to center the ball 52 relative to the rod 56 and opening 54A.

On the opposing side of the container 28, a substantially identical holding member, generally indicated as 64, is provided to hold a larger ball 66. However, in holding member 64, the centering member 62 is not needed since the holding member 64 is sized to center the larger ball 66 with its rod and the elastomer member 68 having a larger opening 68A sized for the larger ball 66. This interchangeability of the holder members 50 and 64 will reduce inventory cost and allows reloading of each holding member with their respective balls.

An annular member 70 is shown connected into a channel 72 in the container bottom portion 28B and includes a plurality of equidistant shaped holes 74A, 74B (others not shown) for receiving threaded shafts 76A, 76B (others not shown). The shafts are used with bolts to connect a bell guide 78 to the bottom of the launching manifold 10. The bell guide 78 includes five (5) 5" openings 78A, 78B (other not shown) to allow visual inspection of the connection of the pipe $P_1$ with the expendable saver sub or nipple 80 used to connect the pipe $P_1$ to the launching manifold 10. Of course, the bell guide 78 and annular member 70 could be removed, if desired, and the manifold 10 could be connected to a kelly (not shown), as would be now known to one skilled in the art. Though not shown, preferably the bell guide 78 has double conical sections. One section, as shown in FIG. 2, is connected with a second conical section having a lower angle to guide the drill pipe to center.

The container top portion 28A includes a spring urged cement check valve assembly 82 threadedly connected in the side opening of the container 28. A cement line 84 is releasable threaded to the assembly 82, preferably only during the cementing operation.

As can be seen when the sleeve 40 is in the fluid flow position, as shown in FIGS. 2, 3, 4 and 5, flow of drilling fluid from passage PA moves down flow passage 26, past check valve assembly 82, and between cylinder 34 and jacket 30, through the opening in seat 46, through nipple 80 to pipe $P_1$.

Turning now to FIGS. 4 and 5, the linkage assembly, generally indicated at 86, for moving the sleeve 40 and U-shaped holding member 44 from the fluid flow position to the dart actuation position is shown in detail. Each side of the container 28 includes a hydraulic actuator 88A, 88B (not shown) to move corresponding arms 90A, 90B by pivotably connected pistons 88A', 88B' (not shown).

Figure 6:
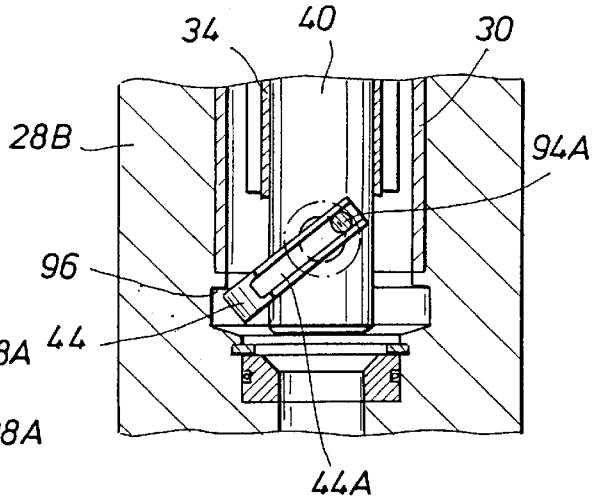
FIG. 6 is an enlarged view of the broken away portion of FIG. 5 with the releasable dart holder shown in the dart actuation position.

The arm 90A rotates cam member 92A and its pin 94A. The pin 94A is received in a slot 44A on one side of the U-shaped holding member 44, as best shown in FIG. 5. A lug 95A pivotly connects the sleeve 40 to the U-shaped holding member 44. As can now be understood, the cylinder slots 34A, 34B align the slots 44A, 44B on each side of the U-shaped holding member 44 with the pins 94A, 94B, when the sleeve 40 is slidably installed in the cylinder 34. Upon extension of the piston 88A', the arm 90A moves the pin 94A in slot 44A so as to pivot the U-shaped member 44 relative to lug 95A to the dart actuation position to release the dart 42. As best shown in FIGS. 6 and 7, further pivoting of the U-shaped holding member 44 is blocked by annular shoulder 96 in the container bottom portion 28B.

Then, after the U-shaped holding member 44 clears the bottom opening 40A of the sleeve 40, the arm 90A is pulled further downwardly by piston 88A', as shown in phantom view of FIG. 5. Since sleeve 40 is constrained from horizontal movement by cylinder 34, this further downwardly pulling of arm 90A and its pin 94A in slot 44A moves the lug 95A rigidly attached to sleeve 40 downwardly to seal the sleeve 40 with soft seat 46. The arm 90B uses similar linkage to provide corresponding forces on the opposing side of the U-shaped holding member 44 and sleeve 40.

Though not shown, it is to be understood that arms 90A, 90B could be disengaged from their respective cam members 92A, 92B and tools, such as pipe wrenches, attached to the outwardly extending rods 93A, 93B of the cam members 92A, 92B to manually rotate the cam members 92A, 92B thereby rotating the U-shaped holding member 44 out of way of dart 42 and pull sleeve 40 to seal with seat 46. Pneumatic operation for dart actuation is also contemplated.

Turning now to FIGS. 8 and 9, the sleeve 40 has now been moved downwardly as shown, to simultaneously seal the sleeve with seat 46 and to open a flow path from passage 26 into sleeve chamber 98 to supply drilling fluid behind the dart 42. This drilling fluid urges the dart 42 out of the dart assembly 29, past nipple 80 and into pipe $P_1$.

Figure 10:
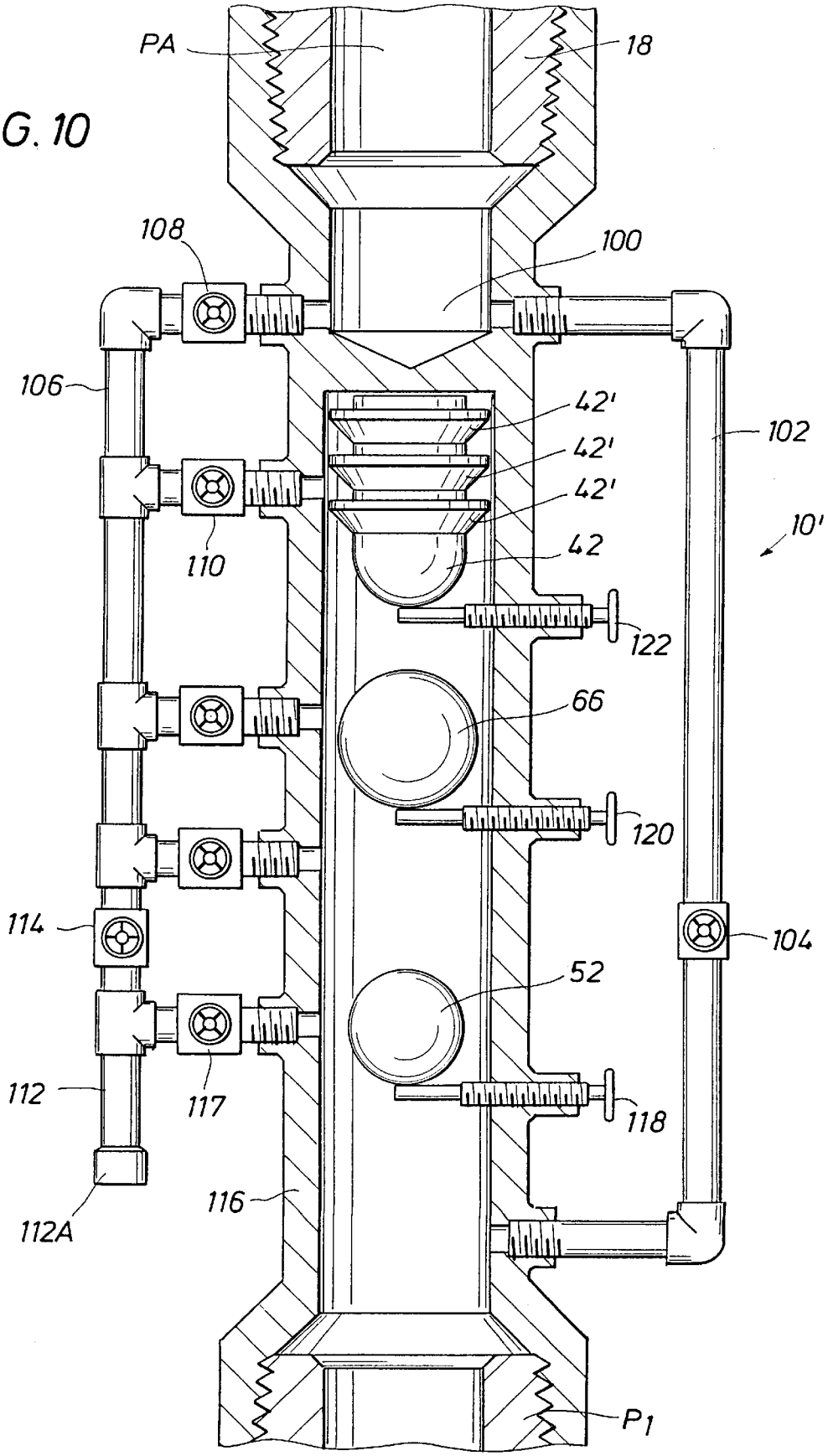
FIG. 10 is an enlarged view of an alternative embodiment of the launching manifold of FIG. 1 with the container shown in section view to better illustrate the releasable holders for the two balls and dart.

Turning to FIG. 10, the alternative launching manifold 10' of FIG. 1 is shown threadedly connected between the top drive 18 and pipe $P_1$ of drill string S. As can now be understood, the drilling fluid line L provides drilling fluid in passage PA that communicates with truncated bore 100 that, in turn, communicates both with a first flow line 102 having a first valve 104, and a second flow line 106 having a second and valves 108 and 110, respectively. A third flow line 112 having nipple 112A is in communication with the second flow line 106, depending on whether valve 114 is in the open or closed position, and the container 116, if valve 117 is open or closed. The third flow line 112, like line 84, shown in FIGS. 2 and 8, is intended only to be releasably connected with the cement slurry or cement supply (not shown) when cementing is performed, as is known by those skilled in the art. As can now be seen, a number of flow configurations of the manifold 10' can be achieved by the opening and closing of valves and supply of fluid, e.g. drilling fluid and cement.

Figure 17:
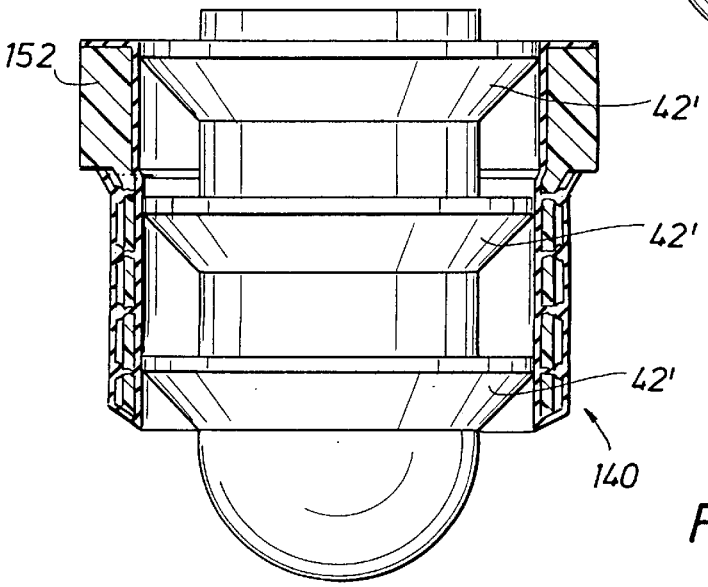
FIG. 17 is a view of the seat, as shown in FIG. 16 to better illustrate the full bore opening provided by the seat upon passage of the dart.

The container 116 of the manifold 10' is sized to receive and releasably hold, from bottom to top, smaller ball 52, larger ball 66, and a drill pipe wiper dart 42 having outwardly and upwardly extending wiper cups 42' that have an outer diameter greater than either of the balls 52 and 66. While the dart 42 of FIGS. 2 and 8 are the preferred configuration of a dart to be used with the present invention, other dart configurations such as shown in FIGS. 10 and 17 could be used. The ball 52, ball 66 and dart 42, as shown in FIG. 10, are all in communication and axially aligned with the drill string S, and in particular pipe $P_1$. Preferably, the balls 52, 66 are fabricated from drillable brass. Example of ball sizes used are a 1¼" smaller ball 52 and a 1.75" larger ball 66. Upon threading outward on rods 118, 120 and 122 the ball 52, ball 66 and dart 42, respectively, are released to fall by gravity into the pipe $P_1$, assuming the rod(s) below it have been fully threaded outward to provide sufficient clearance for the consecutively larger ball 66 or dart 42.

Figure 11:
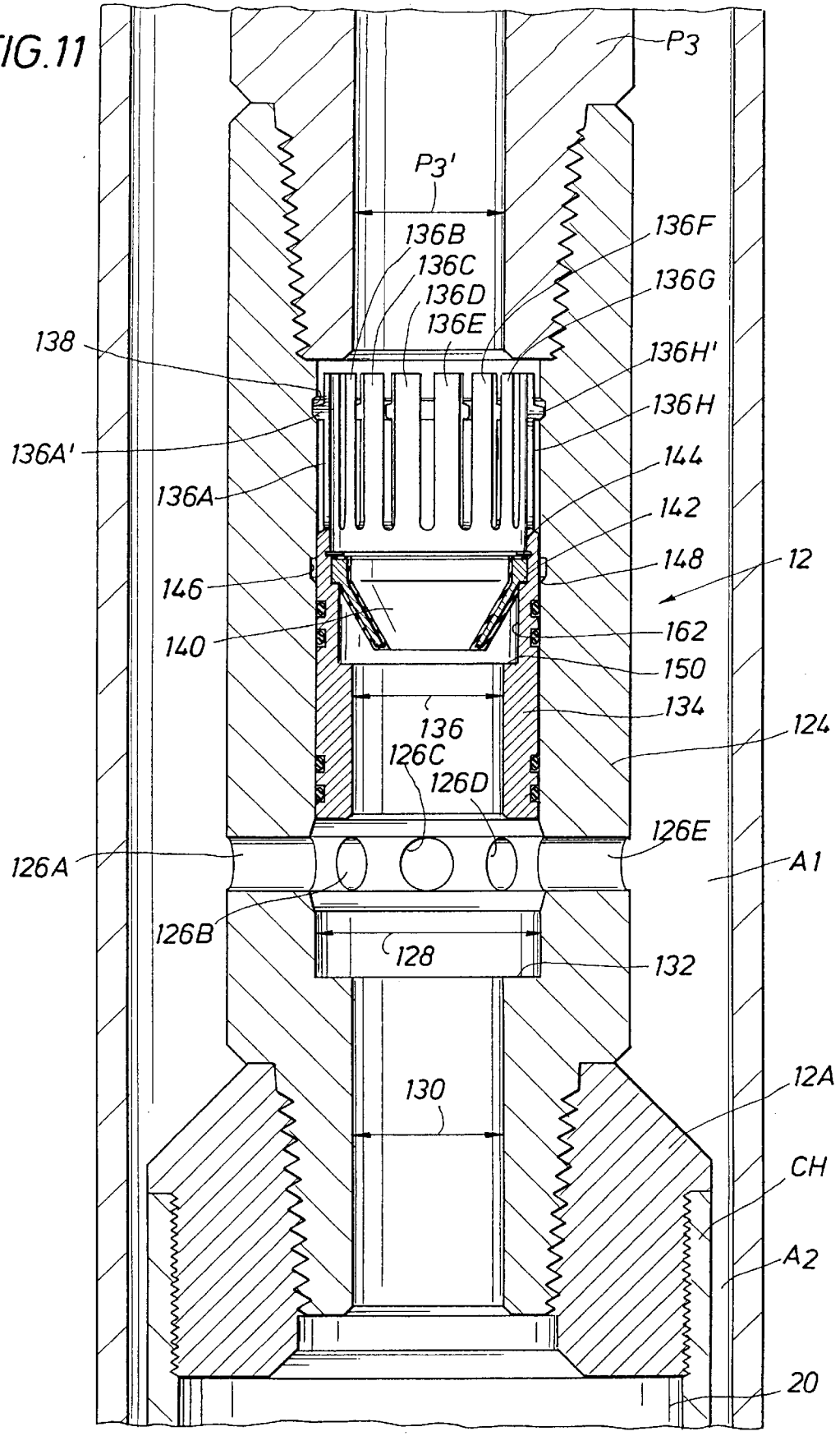
FIG. 11 is an enlarged detailed elevational view of the preferred embodiment of the bypass of the present invention, as shown in FIG. 1, in the open port position and positioned between a pipe and a casing liner.

Turning now to FIG. 11, the bypass 12 is shown in the open port position and threadedly connected between the pipe $P_3$ and the casing liner hanger running tool. The casing liner hanger CH is connected below the casing liner hanger running tool, as is known by one of ordinary skill in the art. An adapter 12A is shown for connection of the housing 124 of the bypass 12 to the casing liner hanger CH. As can now be better seen, the annulus $A_2$ is smaller in area than annulus $A_1$ due to the larger outside diameter of the casing liner 20.

The housing 124 includes eight equidistant spaced flow ports 126A, 126B, 126C, 126D and 126E (others not shown), though any mixture of ports and port sizes could be used to provide the desired flow characteristics while maintaining the structural integrity of the housing 124 sufficient to withstand rotational forces for reaming, as will be discussed below. The sizing and material chosen for the housing 124 provides a rotational and axial load capacity that is not a limitation to the drill string rotational and loading capacity. In one case, AISI 4140 qualified 130K(SI minimum yield material was used. The housing 124 includes a first inside diameter 128 that is greater than the inside diameter $P_3'$ of pipe $P_3$. $P_3'$ is preferably equal to or less than the inside diameter 130 of the housing 124. The diameters 128 and 130 define a blocking shoulder 132 for blocking downward movement of sleeve or cover 134. Sleeve 134 includes an inside diameter 136 that is equal to diameters 130 and equal to or greater than diameter $P_3'$ to provide a "full bore" opening through the housing 124, as will be described in detail below.

The sleeve 134 is shown with sixteen equidistant spaced and sized upwardly extending resilient fingers 136A, 136B, 136C, 136D, 136E, 136F, 136G and 136H (others not shown) each having an outwardly extending shoulder, such as shoulders 136A' and 136H', that are received in a first inwardly facing annular groove 138 in the housing 124 for maintaining the sleeve 134 in the open port position.

The bypass 12 further includes a seat 140 that is attached to the sleeve 134 on an upwardly facing shoulder 142 in the sleeve 134. A removable snap ring 144 is used for securing the seat 140 during use while allowing replacement of the seat 140 after use in a run. A second lower inwardly facing annular groove 146 is provided in the housing 124 and, preferably, has an o-ring 148 provided in this groove 146, as shown.

A second shoulder 150 is provided in the sleeve 134 for clearance of the seat 140 after its use to provide the "full bore" opening of the bypass 12, as will be discussed in detail below.

Figure 12:
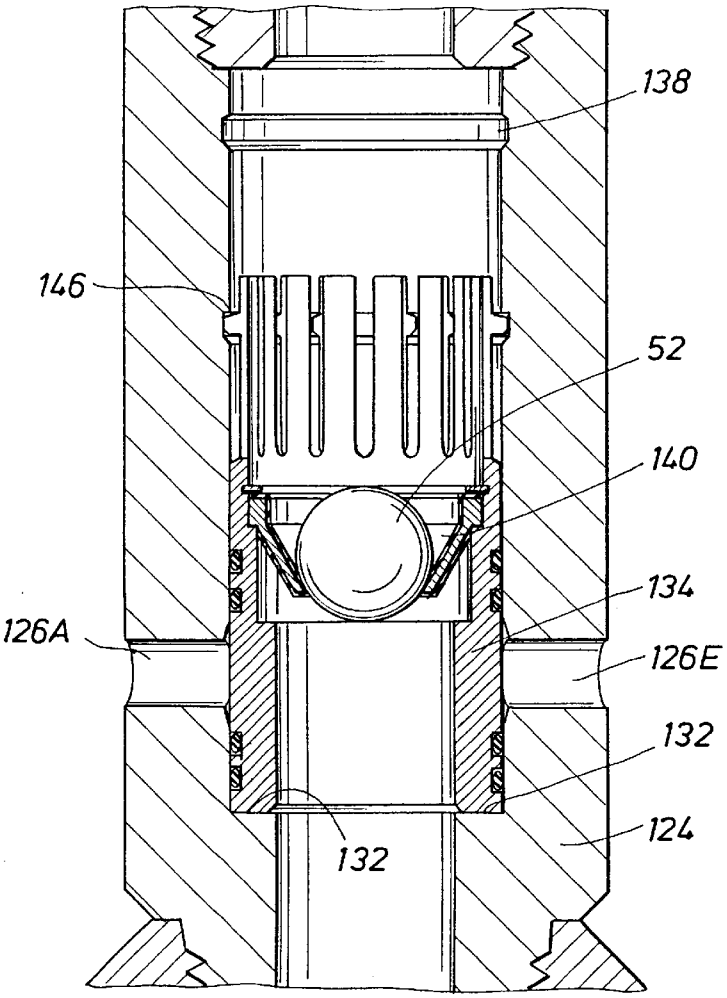
FIG. 12 is a reduced scale elevational view of the bypass of the present invention, as shown in FIG. 11, with the smaller ball of FIGS. 2 or 10 positioned on the seat and the bypass sleeve moved to the closed port position.

Turning now to FIG. 12, the smaller ball 52 is shown seated on seat 140 of sleeve 134 in the housing 124 of the bypass 12. Upon sealing of the ball 52 and the seat 140 with pressurization of the drilling fluid (not shown) within the housing 124, the sleeve 134 moves downwardly to the closed port position to close and seal off (using illustrated annular o-rings) all the flow ports, such as ports 126A and 126E. The force created by the pressurized drilling fluid acting on the ball 52 forces the resilient finger shoulders, such as shoulders 136A' and 136H', inwardly and downwardly until the shoulders of all the fingers are received in the annular groove 146 to resist upward movement of the sleeve 134 after it has moved to the closed port position. Further downward movement of the sleeve 134 is blocked by engagement of the sleeve 134 with blocking shoulder 132.

Figure 13:
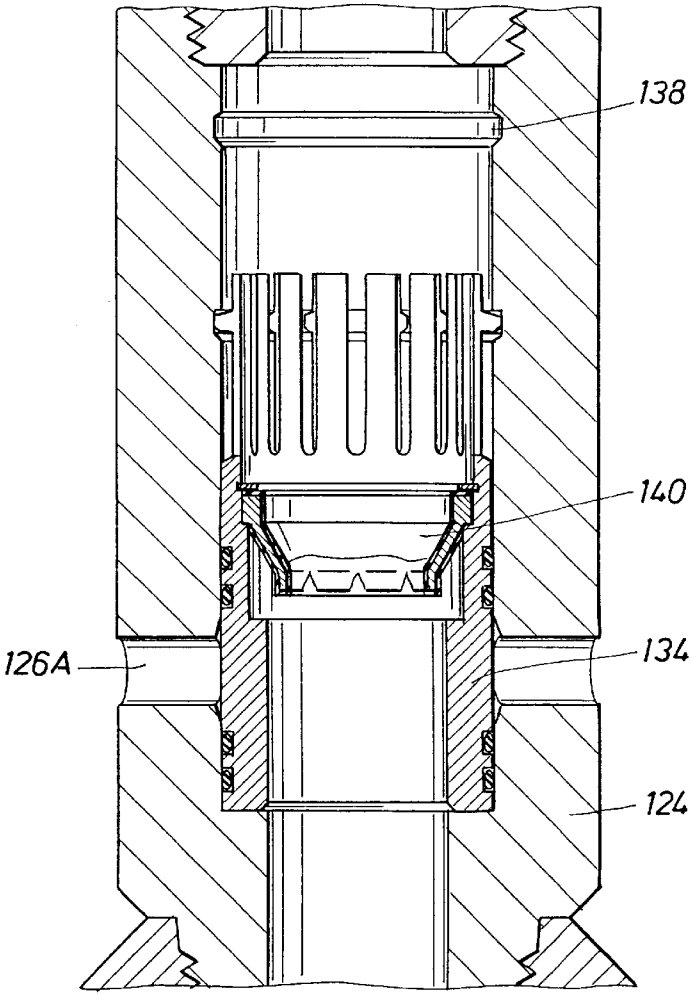
FIG. 13 is an elevational view similar to FIG. 12 but with the ball blown past the seat of the fluid bypass and the increments of the seat shown fractured to allow the smaller ball to pass.

Turning now to FIG. 13, the smaller ball 52 has been blown through the seat 140 upon application of a predetermined pressurized drilling fluid so as to yield or incrementally fracture the seat 140. Turning back to FIG. 1, the ball 52 then drops into the casing liner 20 and through the liner wiper plug 22 and casing liner landing collar 24 and out the end of the guide shoe 14 into the borehole BH formed by the exposed formation EF. When the balls or dart have seated and sealed with seat 140, an increase of pressure in the drilling fluid will be noted by the operator on the surface. Likewise, when the balls or dart have moved past the seat 140, a decrease in drilling fluid pressure will be noted by the operator on the surface. It is also contemplated that the seat 140 could include a flapper held in the closed position by a shear pin of a predetermined shear strength. By application of a predetermined drilling fluid pressure, below the pin shear strength, the sleeve 134 could be moved downwardly to the closed port position. Then at a higher predetermined drilling fluid pressure the pin could be sheared and the flapper swung out or dropped downhole out of the way. Also, an enclosed or sealing position seat could be blown open. These two ideas would eliminate the need for a first ball 52 and reduce the surge pressure if the ports were below the flapper and enclosed seat.

Figure 14:
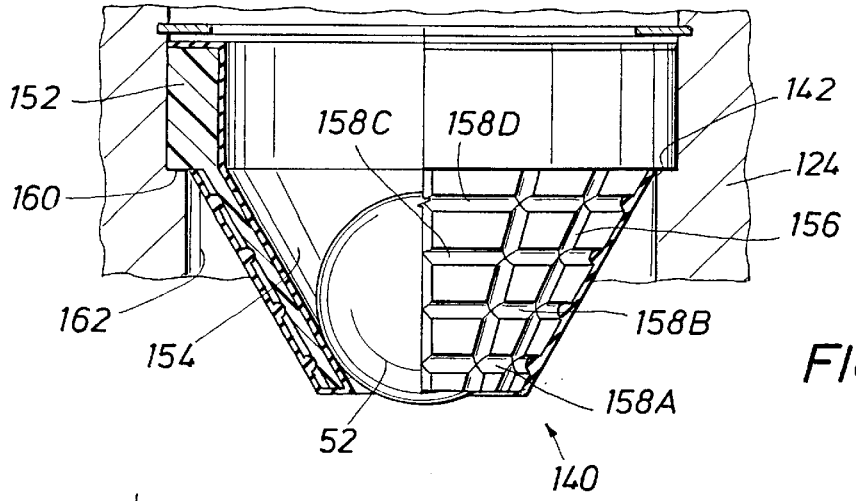
FIG. 14 is an enlarged detailed view of the preferred replaceable seat of the present invention and the smaller ball, as shown in FIG. 12, to better illustrate the molded grooves in the plastic frustoconical portion of the seat.

Turning now to FIGS. 14 to 17, the preferred embodiment of the seat 140, includes a cylindrical portion, generally indicated at 152, and a 30° angled frustoconical portion, generally indicated at 154. The nonfractured inside diameter of the opening of the frustoconical seat is preferably 1" to 1⅛". Preferably, the seat 140 is fabricated from two materials, a phenolic (plastic) component, and an elastomer, such as rubber, preferably a nitrile, coating component to encase the phenolic component. The frustoconical portion 154 of the seat 140 includes a plurality of fracture lines, preferably grooves, molded into the plastic. The fracture lines include a plurality of vertical grooves 156 and a plurality of increasingly larger concentric horizontal grooves 158A, 158B, 158C and 158D to provide predetermined incremental breakaway fracture of the seat 140. Instead of grooves it is contemplated that perforations could also be used as fracture lines. Additionally, it is contemplated that the failure pattern or line may also include raised ribs, as well as grooves, so that fracture occurs and is arrested in a pre-determined fashion. As best shown in FIG. 14, the cylindrical portion 152 presents a downwardly facing shoulder 160 at the juncture with the frustoconical portion 154. Shoulder 160 engages the upwardly facing shoulder 142 of sleeve 134.

Figure 16:
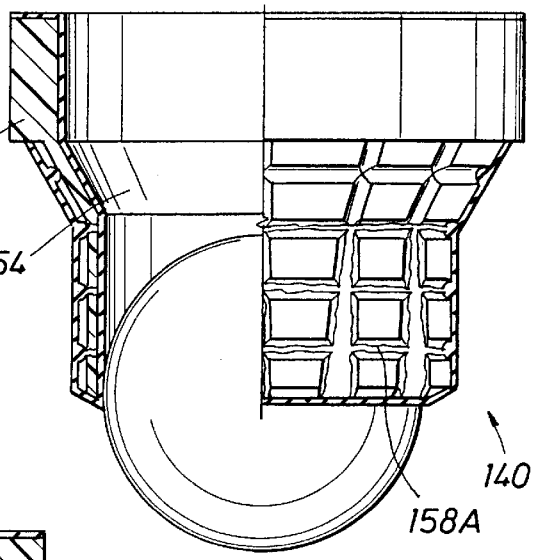
FIG. 16 is a view of the seat, as shown in FIG. 15, to better illustrate the additional incremental fracturing of the seat by the larger ball, as shown in FIGS. 2 or 10.

Some of the benefits of this two material seat with molded fracture lines is that 1.) the phenolic (plastic) component, while providing the desired structural support, will provide a predictable failure point or fracture, so as not to damage the balls or dart blown through the seat, particularly the outwardly extending seal cups 42' on the dart 42, 2.) the elastomer coating will contain the loose incremental plastic pieces resulting from the fractures, 3.) the elastomer provides a soft frustoconical sealing surface used to initiate a seal, on the consecutively launched balls 52, 66 and dart 42 remaining after the previous incremental fracture. That is, the larger ball 66 can seal on the remaining frustoconical elastomer seat 154 after the ball 52 has been blown through so that sufficient pressure can be built up to blow the ball 66 through seat 140, as best shown in FIG. 16. Likewise, the still larger outside diameter seal cups 42' of the dart 42 can seal on the remaining frustoconical rubber seat 154 after the ball 66 has been blown through, so that sufficient pressure can be built up to blow the dart 42 through seat 140.

As can now be understood, after the dart 42 has been blown through the seat 140 the preferably 30° angled frustoconical portion 154 has been incrementally fractured, as best shown in FIG. 17, to permit a substantially "full bore" opening through the housing 124 with minimum or no resistance. The fractured and vertical "frustoconical" portion 154 can hang in the counterbore 162 between shoulders 150 and 142, as best shown in FIGS. 11 and 14.

Alternatively, the seat 140 can be fabricated from a low yield material such as a 1018 mild steel alloy with a 150 to 175 BHN (Brinell hardness number). While both the preferred and alternative embodiments can be split or fractured, any seat that would allow the balls 52, 66 and dart 42 to seal and then pass the housing 124 would be acceptable to practice the present invention. However, if a good seal is not achieved, as is known by those skilled in the art, the drilling fluid pumping could be increased until the ball or dart is blown through the seat.

Figure 18:
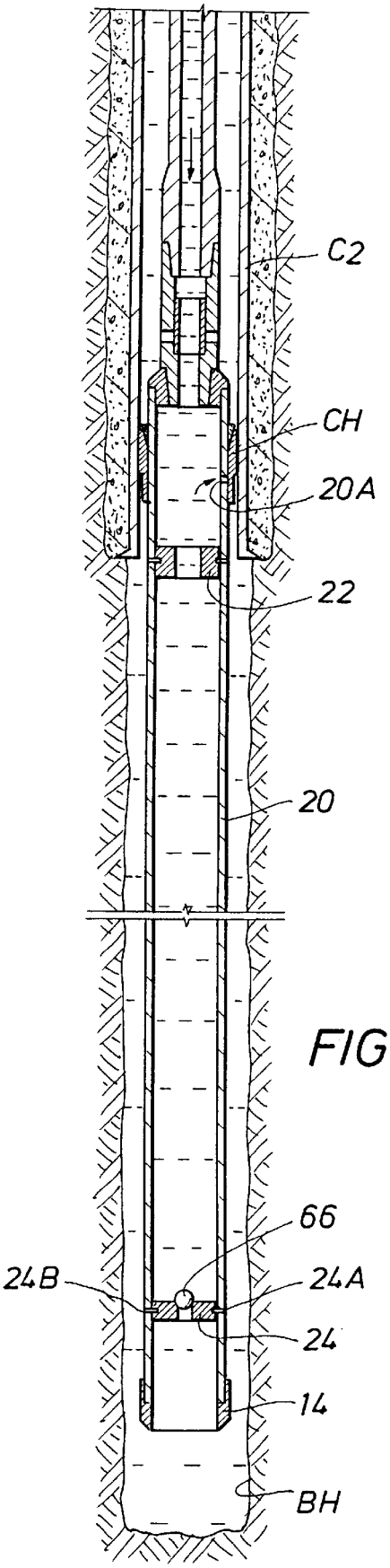
FIG. 18 is an elevational view of the larger ball, as shown in FIGS. 2 or 10, seating on the casing liner landing collar to allow required pressurization of the casing liner to activate a hydraulic casing liner hanger used to hang the casing liner to the casing.

Turning now to FIG. 18, the ball 66 has been dropped from the manifold 10, down the drill string S through pipe $P_3$, blown through seat 140, as best shown in FIG. 16, through bypass 12, through casing liner wiper plug 22 to seat on casing liner landing collar 24. Pressure then is increased in casing liner 20 to actuate hydraulic casing liner hanger CH via casing liner hanger port 20A to hang the casing liner 20 on casing $C_2$. Pressure is then raised higher to blow the shear pins 24A, 24B holding the conventional casing liner landing collar ball seat (not shown) in casing liner 20. The seat of collar 24 and ball 66 are then blown downhole past guide shoe 14 and in the bottom of borehole BH.

Figure 19:
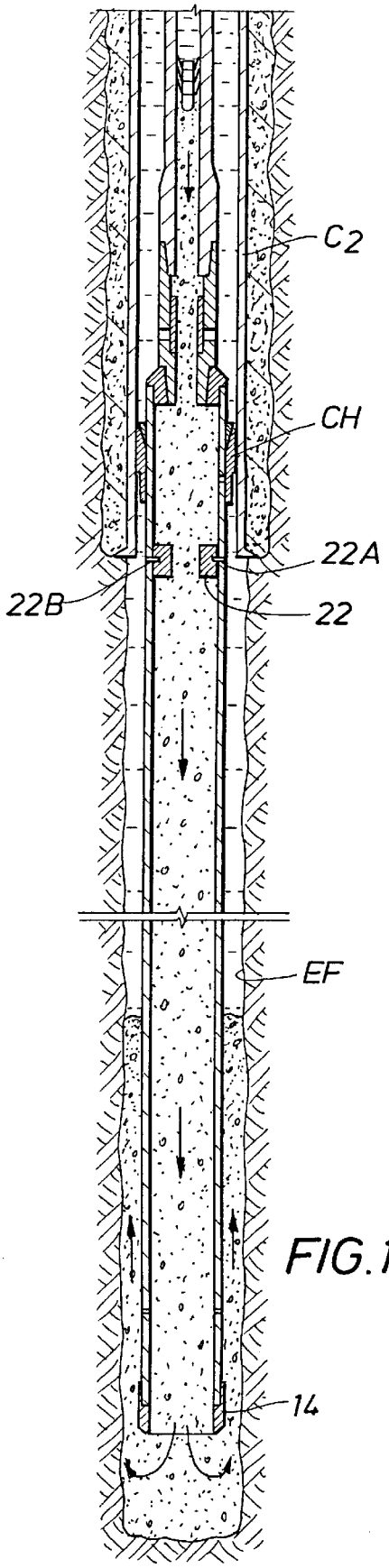
FIG. 19 is an elevational view of cement being pushed by the drill pipe wiper dart down a drill pipe, the bypass of the present invention when in the closed port position, the casing liner and to the annulus between the casing liner and borehole after the casing liner landing collar ball seat has been sheared.

Turning now back to FIG. 2, a predetermined amount of cement flows through line 84 of manifold 10 and down the pipe $P_1$. The dart 42 is then released to allow it to fall down the container. As described above, drilling fluid is then pumped behind the dart 42 to move it down pipe $P_3$, as shown in FIG. 19. Turning to FIG. 17, the dart 42 is then blown through seat 140 of the bypass 12 thereby incrementally fracturing the seat 140 to provide a "full bore" opening.

Turning now to FIG. 20, the dart 42 has engaged the casing liner wiper plug 22 and after sufficient drilling fluid pressure, shears the pins 22A and 22B, as best shown in FIGS. 19 and 20, and moves the wiper plug 22 down to the casing liner landing collar 24. The plug 22 latches into the profile of the collar 24 thereby moving the cement $CE_3$ out into the annulus $A_3$ between the casing liner 20 and the exposed formation EF of the borehole BH. As best shown in FIG. 20, cement also remains in the casing liner 20 between the elevation of the collar 24 and the guide shoe 14.

METHOD OF USE

The method of use of the system of the present invention including the manifold 10, bypass 12 and guide shoe 14, in combination with other existing components allows a casing liner 20 to be run downhole with reduced surge pressure, hanging of the casing liner 20 on the existing casing $C_2$ and cementing of the casing liner 20 in the borehole to be accomplished in a single trip of the drill string S downhole.

Figure 15:
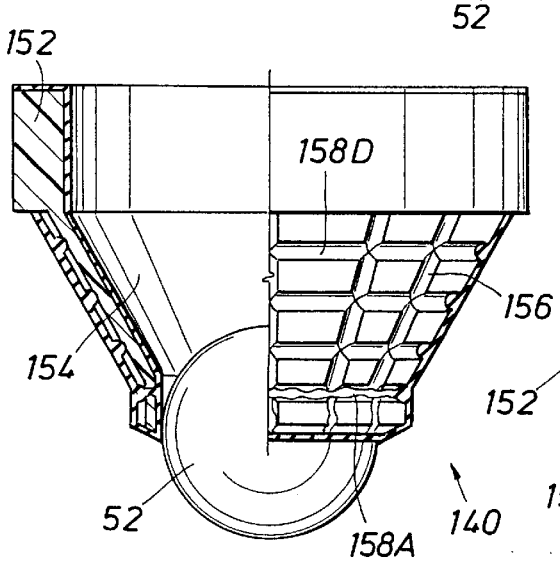
FIG. 15 is a view of the seat, as shown in FIG. 14, to better illustrate the fracturing of the seat by the smaller ball of FIG. 14 along the molded plastic grooves with the plastic being contained by the elastomer coating.

As shown in FIG. 1, when running a casing liner 20, sufficient drill string S is provided or tripped into the well between the manifold 10 and the bypass 12 to reach the desired depth, with the flow ports in the housing 124 of the bypass 12 in the open port position, as best shown in FIG. 11. Upon reaching the desired depth, the smaller ball 52 is released from the manifold 10, as shown in FIG. 2 or FIG. 10, down the drill string S until it engages the "breakaway" seat 140 of the sleeve 134, as best shown in FIGS. 12 and 14. After the ball 52 is seated, the mud is pressurized to move the sleeve 134 to the closed port position. Further pressurization of the drilling fluid forces or "blows" the ball 52 through the seat 140 resulting in incremental fractures to the seat 140, as best shown in FIGS. 13 and 15, allowing the ball 52 to drop through the bottom of the casing liner 20.

Upon locating the casing liner 20 at the desired depth, the larger ball 66 is then released from the manifold 10, again down through the string S and through the seat 140 resulting in additional incremental fractures to the seat 140, as best shown in FIG. 16, landing on the collar 24, as best shown in FIG. 18. Again, the drilling fluid is pressurized so as to hydraulically set the hanger CH via port 20A, as shown in FIG. 18. The fluid pressure then is further increased so that the shear pins 24A, 24B fail and the seat of collar 24 and ball 66 drop out of the casing liner 20 into the borehole BH.

The cement $CE_3$ supply is then connected via the flow line 84 and after pressure opens check valve assembly 82, cement $CE_3$ is pumped through the manifold 10 so that the cement $CE_3$ moves down the drill string S. The dart 42 is then released, as described above, and drops onto the cement $CE_3$. Drilling fluid is pumped behind the dart 42 to move the dart 42 downwardly thereby pushing the cement $CE_3$ down the string S, as shown in FIG. 19. The dart 42 then moves through the seat 140 resulting in the full incremental fracturing of the seat 140, as shown in FIG. 17, and engages the wiper plug 22. The plug 22, after failure of shear pins 22A, 22B, then is pushed by pressurized drilling fluid down the casing liner 20 thereby pushing the cement $CE_3$ up the annulus $A_3$ between the casing liner 20 and the borehole BH until the plug 22 is engaged in the collar 24 thereby permitting a normal cementing job of the casing liner 20 in the borehole BH, as best shown in FIG. 20. As can now be understood, the system provides a method where a casing liner 20 can be run at a relatively higher rate of speed, even with tight clearances between the liner 20 and the casings SH, $C_2$. The casing liner 20 can then be hung from the casing $C_2$, and cemented in the borehole BH all on a single trip downhole.

Advantageously, the manifold 10 does not require to be replaced with other manifolds or containers to launch balls and dart(s) but can perform all the steps of closing the port, hanging the liner 20 and cementing the liner 20 without replacement of or additions to the container. Additionally, the invention allows "full bore" opening through the housing 124 while providing structural integrity between the pipe $P_3$ and liner 20 to allow rotation. The manifold 10 permits circulation of drilling fluid to the casing liner 20 when needed, such as shown in FIG. 21, for washing while reaming of a rubble zone RZ or other problematic borehole instabilities with a specially adapted guide shoe GS or 14' having teeth T thereon, as will be discussed below in detail. The "full bore" breakaway seat 140, while allowing circulation through the casing liner 20 up the annuli A3, A2 and A1, also allows the larger ball 66 and dart 42 to pass through without damage.

FIG. 21—Feb. 12, 1997 EXPERIMENTAL RUN OF THE SYSTEM

Below is a description of the system run on assignee's offshore rig on Feb. 12, 1997, as best shown in FIG. 21. A borehole BH' was drilled from the previous 11⅞" casing $C_2$' at 12100' MD/TVD to 13813' MD/TVD using a 10⅝" by 12¼" DPI B1-Center bit. A 10⅝" hole was drilled from 13813' to 14427' MD/TVD. There were severe difficulties drilling the rubble zone RZ beneath the salt from ±14130' to ±14205'. The hole was enlarged to 14¾" (not shown) using an underreamer and sidewinders from 13700' to 14430' to make 3' of new hole from 14427' to 14430'.

A 250 barrel pill of heavy drilling fluid (3 pounds per gallon higher than drilling fluid density used to drill interval) was placed in the wellbore prior to retrieving the drill string in order to run a casing liner.

A total of 61 joints of 9⅞" (9.875"), 62.8#, Q-125 STL casing 20' were run in a previous casing $C_2$' having an inside diameter of 10.711". The casing liner/casing clearance was a total distance of 0.836" or 0.418" on each side of a centered annulus of the casing liner and casing. The casing liner and borehole clearance was a total distance of 2.375" or 1.188" on each side of the centered annulus of the casing liner and borehole. A TIW No. 1718.02 1B-TC R·W/PIN TOP "HYDRO-HANGER" hydraulic casing liner hanger HGR was run. Six (6) integral blade centralizers (not shown) manufactured by Ray Oil Tool Co., Inc. of Lafayette, La. were run. A casing/guide shoe GS or 14' with multiple openings and no float valve was used. Total length of casing liner 20', guide shoe 14', and TIW equipment was 2615'. The bypass 12' of the present invention was used, but with sleeve seat 140', for closing the port of the housing 124'; was fabricated with a 1018 mild steel alloy with 150 to 175 BHN (Brinell Hardness Number).

The casing liner 20' was run into the hole BH' and the above described bypass 12' was attached to the top of the TIW casing liner hanger. Running speed of the casing liner 20' was limited to 1.5 minutes/stand to reduce surge pressure. The bypass 12' allowed full flow of fluid, therefore there was no excess time spent on the slips during connections. That is, there was no waiting for drilling fluids pressures to equalize so that the drilling fluid movement up the pipe would cease. The casing liner 20' tagged up at 14130' (approximate top of the rubble zone RZ). The bypass 12' allowed the liner 20' to be used to wash and ream from the beginning of the obstruction all the way to the desired setting depth of 14281'. The casing liner hanger HGR was set and released and preparations for cementing were made.

Through the use of the bypass 12' and shoe GS, the casing liner 20' was able to be run with a minimum of time spent on the slips during connections (thus reducing the chances for differential sticking), the liner 20' was able to be used to wash and ream to bottom of the borehole BH" once problems were encountered, and circulation through the liner 20' was possible because it was not necessary to set it on bottom to close the bypass 12'. Circulation was established and the liner 20' was cemented in place using normal cementation methods. However, in this run no wiper plug was used.

Instead, the cement was displaced down the pipe using a Halliburton rubber ball and the cement was displaced out of the casing liner based on volumetrics.

Due to the rubble zone RZ, cement did not reach the liner top 20" during the cement job. This had been expected and a casing liner top packer (not shown) was run to seal the liner top 20". The bypass 12' was also used to run the packer to allow for a running speed of 1.5 min/stand. Running speed would otherwise have been drastically reduced from the top of the previous liner $C_2$' downward, as the packer is designed to seal against the ID of the 11⅞" casing. A liner top packer used in the Davis Type PVTS automatic float equipment run history, as described in the above background of the invention, averaged 5.5 min/stand; the extra 4 min/stand would have added≈8¼ hours to the February 12th trip. Both the liner top packer and the liner shoe (cement job) tested good and neither required remedial measures.

This February 12th liner run faced an additional problem not present in the wellbores, described in the background of the invention, in that it was necessary to drill through a rubble zone RZ present beneath a salt mass. This rubble is extremely unstable and chances were high that some of it would be present in the wellbore. In order to prevent any foreign matter in the wellbore from forming a bridge or packing off, this liner 20' needed to be able to wash and ream through the rubble zone. The guide shoe GS used for this liner had teeth T cut into the bottom for this purpose, as well as an open bore to prevent plugging. Neither the TIW nor the Halliburton fluid bypass was capable of being moved to the closed port position without touching bottom or, in the case of the Halliburton fluid bypass subjected to the required rotational torque to ream.

The utilization of the system of the present invention in this February 12th run allowed: 1) the liner to be run with a minimum of time spent sitting on the slips during connections, 2) a minimum of surge pressure placed on the exposed formation EF' in both running the liner 20' and the packer (not shown), 3) washing and reaming with the liner 20' from the top of the rubble zone RZ to the desired setting depth, 4) normal circulation due to not plugging the liner 20' by setting it on bottom of the borehole BH", 5) an acceptable cement job to be performed, and 6) considerable time savings during all of the above activities.

The foregoing disclosure and description of the invention are illustrative and explanatory thereof, and various changes in the details of the illustrated apparatus and construction and method of operation may be made without departing from the spirit of the invention.

What is claimed is:

1. Apparatus for reducing surge pressure while running a pipe having an inside diameter in drilling fluid, said apparatus comprising:

a housing connectable with the pipe, said housing having openings at its ends and at least one flow port between the openings to permit flow of the drilling fluid from the inside of said housing, a sleeve having an inside diameter that is equal to or greater than said pipe inside diameter, said sleeve movable between an open port position and a closed port position, and a seat attached to said sleeve and movable between a sealing position and a yield position, whereby when said sleeve is in the open port position drilling fluid flows from said housing to reduce surge pressure while running the pipe and when said sleeve is in the closed port position said seat provides passage through said housing.

2. Apparatus of claim 1 wherein said sleeve includes latching members to resist movement of said sleeve from the dosed port position.

3. Apparatus of claim 2 wherein said latching members comprise a plurality of fingers and said housing including a groove to receive said fingers.

4. Apparatus of claim 1 wherein said seat is fabricated from plastic having an elastomer coating.

5. Apparatus of claim 1 wherein said seat is fabricated to breakaway in increments while maintaining a sealing surface as larger objects move past said seat.

6. Apparatus of claim 1 wherein said housing having a first inside diameter that is greater than the pipe inside diameter and a second inside diameter substantially equal to the pipe inside diameter, wherein said first inside diameter and said second inside diameter forming a blocking shoulder in said housing.

7. Apparatus of claim 1 further comprising a ball adapted to seal with said seat and pressurizing the drilling fluid above said ball to a first predetermined level to move said sleeve to said closed port position.

8. Apparatus of claim 7 further comprising pressurizing the drilling fluid above said ball to a second predetermined level to force said ball through said yieldable seat.

9. Apparatus of claim 1 further comprising said seat being closed when in the sealing position and forced open when in the yield position.

10. Apparatus of claim 1 further comprising a ball seating on a yieldable metal seat adapted to move said sleeve from said open port position to said closed port position.

11. Method for reducing surge pressure while running a pipe downhole, comprising the steps of:

connecting a housing having a flow port to the bottom of a pipe, running said housing downhole, receiving drilling fluid through said housing and out said flow port to reduce surge pressure, closing said flow port using drilling fluid pressurized within said housing to a first predetermined level, and clearing an opening in said housing using drilling fluid pressurized within said housing to a second predetermined level while maintaining said flow port in the closed position.

12. Method of claim 11 further comprising the step of rotating the pipe that in turn rotates said housing.

13. Method of claim 11 wherein the step of connecting includes the step of connecting said housing between the pipe and an apparatus.

14. Method of claim 13 wherein the apparatus is a casing liner.

15. Method of claim 14 further comprising casing positioned downhole wherein the step of flowing includes the step of positioning the housing port above said casing liner so that said port permits flow of drilling fluid to an annulus between the pipe and said casing.

16. Method of claim 15 wherein the annulus between said casing liner and said casing is less than said annulus between the pipe and said casing.

17. Method of claim 14 wherein the step of receiving includes the step permitting flow of drilling fluid through said casing liner to said port in said housing.

18. Method of claim 11 wherein the step of closing includes a sleeve inside said housing movable from a open port position to a closed port position.

19. Method of claim 18 wherein the step of closing further includes the step of dropping a first ball in said pipe, and seating the ball on a seat whereby said drilling fluid pressurized to said first predetermined level moves said sleeve to the closed port position.

20. Method of claim 11 wherein the step of clearing includes the step of blowing a ball past a seat attached to said sleeve using drilling fluid pressurized to said second predetermined level.

21. Method of claim 11 further comprising the step of clearing an opening in said housing that is equal to or greater than the opening in the pipe.

22. Method of claim 19 further comprising the steps of dropping a second ball in said pipe, permitting the second ball to move through said housing to said casing liner, seating the second ball on a casing liner landing collar to seal the inside of said liner, and pressurizing said drilling fluid above said casing liner landing collar to a third predetermined level to hydraulically hang said liner.

23. Method of claim 22 further comprising the step of pressurizing said fluid to a fourth predetermined level to shear pins holding the ball seat of the collar in said liner.

24. Method of claim 11 further comprising the step of hydraulically actuating a liner hanger through said cleared housing opening.

25. Apparatus adapted for closing a surge reduction port in a housing connected between a pipe and a casing liner, and having a casing liner, said apparatus comprising a container having a top and a bottom and a chamber sized to receive a first ball and another ball, said container connected above the pipe, a first holding member movable between a hold position to hold said first ball in said container, and a release position to release said first ball down the pipe, a second holding member movable between a hold position to hold said other ball in said container and a release position to release said other ball down the pipe, a flow line to move fluid from the top of said container past said balls without said fluid engaging said balls, and wherein said container includes a sleeve movable between a fluid flow position to allow flow of fluid past a dart in said sleeve and a dart actuation position to use said fluid to move said dart out of said container.

26. Apparatus of claim 25 further comprising a dart received in said container, and a third holding member movable between a hold position to hold said dart and a release position to release said dart when said sleeve has been moved to the dart actuation position.

27. Apparatus of claim 25 further comprising a dart assembly removably positioned in said container.

28. Apparatus of claim 25 wherein said fluid is drilling fluid that is received from the top portion of the container.

29. Apparatus of claim 28 further comprising a cylinder disposed in said container in slidable connection with said sleeve to permit flow of said fluid between said cylinder and the inside surface of said container when said sleeve is in the fluid flow position.

30. Apparatus of claim 25 further comprising a cylinder disposed in said container in slidable connection with said sleeve to permit flow of said fluid within said cylinder when said sleeve is in the dart actuation position.

31. Apparatus of claim 26 further comprising a releasable cement flow line to supply cement into said container and down the pipe, said dart being positioned above said cement so that when said sleeve is moved to said da rt actuation position and the holding member moved to the released position said fluid moves said dart and the cement down said pipe.

32. Method for closing a port in a housing connected between a pipe and a casing liner while running the casing liner, and hanging the liner, comprising the steps of positioning a container having at least a first ball and a dart above the pipe, rotating the container, receiving drilling fluid in the top portion of the container past a cylinder containing the dart and said first ball, allowing the drilling fluid to flow, and dropping said first ball to close a port in a housing connected between the pipe and the liner.

33. Method of claim 32 further comprising the step of dropping the second ball to hang the liner, positioning a dart in a chamber in said container, pumping a predetermined amount of cement into said container around said dart without moving said dart, releasing said dart on top of the cement, and pumping drilling fluid on top of said dart to move said cement down the pipe.

34. System for reducing surge pressure while running a pipe in drilling fluid in a borehole, comprising:

a container having a first ball, the pipe being connected below said container and in communication with said first ball, a housing having openings and a flow port between the openings and connected below the pipe, one of said openings permitting flow of the drilling fluid through said housing and out said port to reduce surge pressure while running the pipe downhole, and said flow port in the housing closed without setting the system on the bottom of the borehole, said first ball movable past said housing using drilling fluid pressurized to a predetermined level.

35. System of claim 34 further comprising a dart centrally disposed in a chamber in said container and in communication with the pipe, and a liner being cemented downhole by supplying a predetermined amount of cement moved between the borehole and said liner by said dart.

36. System of claim 34 wherein closing the port used to reduce surge pressure and moving the first ball past the housing are accomplished without tripping the pipe from downhole.

37. System for reducing surge pressure while running and hanging a casing liner during a single trip downhole, the system comprising:

container having a first ball and a second ball, the pipe connected below said container and in communication with said first ball and said second ball, a housing having openings and a flow port between the openings and connected below the pipe, one of said openings permitting flow of drilling fluid through said housing and out said port to reduce surge pressure while running the liner downhole, said flow port in the housing closed by said first ball urged by the drilling fluid, said ball movable past said housing upon a predetermined pressurized application of drilling fluid, and said liner connected below said housing and hung downhole upon actuation using said second ball.

38. System of claim 37 further comprising a borehole, a dart disposed in said container and in communication with the pipe, said liner being cemented downhole by supplying a predetermined amount of cement moved between the borehole and said liner by said dart.

39. System for reducing surge pressure while running a casing liner, hanging the casing liner from a casing and cementing the casing liner in a borehole during a single trip downhole, the system comprising:

a container having a ball, the pipe connected below said container and in communication with said ball, a housing having a flow port and connected below the pipe, said liner permitting flow of drilling fluid through said housing and out said port to an annulus between the pipe and said casing to reduce surge pressure while running the liner downhole, a sleeve in the housing moved downwardly to a dosed port position using the drilling fluid at a first predetermined pressurized drilling fluid level, upon application of a second predetermined pressurized drilling fluid level said sleeve provides a passage through said housing, and said liner connected below said housing and hung from the casing after actuation using said ball moving through said passage in said housing.

40. System of claim 39 further comprising a dart disposed in said container and in communication with the pipe, said liner being cemented by supplying a predetermined amount of cement moved between the borehole and the liner by said dart.

41. Apparatus for reducing surge pressure while running a casing liner in drilling fluid, the casing liner being suspended from a pipe having an opening, said apparatus comprising:

a housing releasably connectable with the pipe, said housing having openings at each of its ends and a flow port between the openings to permit flow of drilling fluid from the inside of said housing, a cover movable between an open port position and a closed port position, said cover moved to said closed port position by application of drilling fluid at a first predetermined level, and a seat movable between a plugged position and a blow position, whereby when said cover is in the open port position drilling fluid flows from said housing to reduce surge pressure while running a liner and when said cover is in the closed port position said seat allows passage to said liner.

42. Apparatus of claim 41 further comprising pressurizing the drilling fluid to a second predetermined level to blow said seat.

43. Apparatus of claim 41 wherein said cover is a sleeve that includes latching members to resist movement of said sleeve from the open port position.

44. Apparatus of claim 41 wherein said cover provides an opening equal to or greater than said pipe opening.

45. Apparatus of claim 43 further comprising pressurizing the drilling fluid to said first predetermined level to move said sleeve to a blocking shoulder in said housing.

46. Method for reducing surge pressure while running a liner from a pipe and hanging the liner from a casing in a single trip downhole, comprising the steps of:

connecting a housing having a flow port disposed between the pipe and the liner, running said housing and the liner downhole, receiving drilling fluid through the liner to said housing and out said flow port to reduce surge pressure, closing said flow port using drilling fluid pressurized within said housing to a first predetermined level, clearing an opening in said housing using drilling fluid pressurized within said housing to a second predetermined level while maintaining said flow port in the closed position, and hanging the liner.

47. Method of claim 46 wherein the step of hanging further comprises the step of dropping a second ball in the pipe, permitting the second ball to move through said housing to the liner, seating the second ball to seal the inside of said liner, and pressurizing said drilling fluid above said liner collar to a third predetermined level to hydraulically hang said liner.

48. Method of claim 46 further comprising the step of rotating the pipe that in turn rotates said housing.

49. Method of claim 46 wherein the step of running includes the step of submerging the liner in drilling fluid downhole in close clearance with the casing.

50. Method of claim 46 wherein the step of receiving includes the step of positioning the housing port above the liner so that said port permits flow of drilling fluid to the annulus between the pipe and the casing whereby the area of the annulus between the liner and the casing is less than the area of the annulus between the pipe and the casing.

51. Method of claim 46 wherein the step of closing includes a sleeve inside said housing movable from an open port position to a dosed port position.

52. Method of claim 51 wherein the step of dosing further includes the step of dropping a first ball in the pipe, and seating the ball on a seat whereby the drilling fluid pressurized to said first predetermined level moves said sleeve to the closed port position.

53. Method of claim 46 wherein the step of clearing includes the step of blowing a ball past a seat attached to said sleeve using drilling fluid pressurized to said second predetermined level.

54. Method of claim 46 further comprising the step of sealing a dart on a seat in the housing, blowing the dart through the housing, pushing cement with the dart, and cementing said liner in the borehole.

55. Apparatus for use in a bypass housing, wherein said housing is used for reducing pressure while running and hanging a liner downhole, the apparatus comprising:

a removable seat having a cylindrical portion having an inside diameter and a frustoconical portion having an interior surface and an exterior surface, said cylindrical portion having a downwardly facing shoulder disposed at the juncture with said exterior surface of said frustoconical portion, and said frustoconical portion having a plurality of fracture lines to facilitate predetermined fracture of said frustoconical portion, said interior surface of said frustoconical portion providing a sealing surface.

56. Apparatus of claim 55 wherein said plurality of fracture lines are raised ridges.

57. Apparatus of claim 55 wherein said cylindrical portion and said frustoconical portion are fabricated from plastic.

58. Apparatus of claim 57 wherein said plastic cylindrical portion and frustoconical portion are coated with an elastomer to contain the fractured increments of plastic and to provide a sealing surface.

59. Apparatus of claim 55 wherein said plurality of fracture lines are a plurality of horizontal concentric grooves crossed by a plurality of vertical lines to facilitate incremental predetermined fracture of said frustoconical portion.

60. Apparatus of claim 57 wherein said fracture lines are molded into said plastic.

61. Apparatus of claim 55 wherein said plurality of fracture lines facilitates fracture of said frustoconical portion so that said frustoconical portion has a fractured inside diameter substantially equal to the inside diameter of said cylindrical portion.

* * * * *